US010344549B2

(12) United States Patent
Skeels et al.

(10) Patent No.: US 10,344,549 B2
(45) Date of Patent: Jul. 9, 2019

(54) SYSTEMS FOR REMOVING BLOCKAGES IN SUBSEA FLOWLINES AND EQUIPMENT

(71) Applicant: FMC TECHNOLOGIES, INC., Houston, TX (US)

(72) Inventors: Harold Brian Skeels, Kingwood, TX (US); Mark Alan Johnson, Houston, TX (US); Kevin Roy Knight, Spring, TX (US)

(73) Assignee: FMC Technologies, Inc., Houston, TX (US)

( * ) Notice: Subject to any disclaimer, the term of this patent is extended or adjusted under 35 U.S.C. 154(b) by 0 days.

(21) Appl. No.: 15/770,572

(22) PCT Filed: Feb. 3, 2016

(86) PCT No.: PCT/US2016/016320
§ 371 (c)(1),
(2) Date: Apr. 24, 2018

(87) PCT Pub. No.: WO2017/135941
PCT Pub. Date: Aug. 10, 2017

(65) Prior Publication Data

US 2018/0298711 A1 Oct. 18, 2018

(51) Int. Cl.
*E21B 31/03* (2006.01)
*E21B 37/06* (2006.01)
(Continued)

(52) U.S. Cl.
CPC ..... *E21B 31/03* (2013.01); *E21B 23/08* (2013.01); *E21B 37/06* (2013.01);
(Continued)

(58) Field of Classification Search
CPC ..... E21B 31/03; E21B 37/06; E21B 41/0007; E21B 41/04
See application file for complete search history.

(56) References Cited

U.S. PATENT DOCUMENTS 3,638,722 A 2/1972 Talley, Jr.
6,637,514 B1 10/2003 Donald et al.
(Continued)

FOREIGN PATENT DOCUMENTS

WO 2010151661 A2 12/2010
WO 2013137861 A1 9/2013
(Continued)

OTHER PUBLICATIONS

First Examination Report No. 1 dated May 7, 2018, for Australian Patent Application No. 2016391059, filed on Feb. 3, 2016 (PCT Effective Date).
(Continued)

*Primary Examiner* — Matthew R Buck
(74) *Attorney, Agent, or Firm* — Amerson Law Firm, PLLC

(57) ABSTRACT

Disclosed are various to blockage remediation systems for removing blockages, e.g., hydrate plugs, debris plugs, etc., from subsea flowlines and subsea equipment. In one illustrative embodiment, the system includes, among other things, an ROV (102) deployed into a body of water from a surface vessel (10) and a blockage remediation skid (104) that is operatively coupled to the ROV (102), wherein the skid (104) includes at least a skid fluid inlet (108A) and a skid fluid outlet (106A). The system also includes a returns downline (106) and a pressurized lift-gas supply downline (108) that extends into the body of from the vessel (10). The returns downline (106) is operatively coupled to the skid fluid outlet (106A), while the pressurized lift-gas supply downline (108) is adapted to be operatively and directly coupled to the blockage remediation skid (104) or operatively and directly coupled to the returns downline (106). The system also includes a remediation flow line (110) that
(Continued)

is operatively coupled to the skid fluid inlet (110A) and a flowline (16) or an item of subsea equipment (12, 15 or 17).

31 Claims, 15 Drawing Sheets

(51) Int. Cl.
*E21B 41/00* (2006.01)
*E21B 41/04* (2006.01)
*E21B 23/08* (2006.01)
*E21B 41/08* (2006.01)

(52) U.S. Cl.
CPC ..... *E21B 41/0007* (2013.01); *E21B 41/04* (2013.01); *E21B 41/08* (2013.01)

(56) References Cited

U.S. PATENT DOCUMENTS 7,201,229 B2 4/2007 White et al.
7,487,836 B2 2/2009 Boyce et al.
7,650,944 B1 * 1/2010 Boyle ..... B63B 27/24 137/15.12
7,770,653 B2 8/2010 Hill et al.
8,066,063 B2 11/2011 Donald et al.
8,322,442 B2 12/2012 Voss
8,376,050 B2 * 2/2013 Cumming ..... E21B 37/06 166/250.01
8,381,578 B2 * 2/2013 Sweeney ..... B63C 11/42 405/154.1
8,540,018 B2 9/2013 Donald et al.
8,689,879 B2 4/2014 Patel et al.
8,770,892 B2 * 7/2014 Sweeney ..... B08B 9/055 405/184.1
8,776,891 B2 7/2014 Donald et al.
9,062,515 B2 6/2015 Borsheim
9,238,955 B2 * 1/2016 Mancini ..... E21B 29/12
9,574,420 B2 * 2/2017 Hall ..... E21B 17/20
9,581,356 B2 * 2/2017 Papasideris ..... F24H 9/2014
2007/0166171 A1 7/2007 Kondo
2010/0047022 A1 * 2/2010 Le Moign ..... E02F 3/907 405/184.1
2011/0067881 A1 3/2011 Blake
2011/0158824 A1 * 6/2011 Wright ..... B01D 19/0042 417/53
2011/0198092 A1 * 8/2011 Machin ..... E21B 17/012 166/349
2012/0193104 A1 8/2012 Hoffman et al.
2014/0048269 A1 2/2014 Bryson et al.
2015/0114658 A1 4/2015 Donald et al.
2015/0292291 A1 10/2015 Donald et al.
2017/0002651 A1 * 1/2017 Tvedt ..... E21B 41/04

FOREIGN PATENT DOCUMENTS

WO 2014074685 A1 5/2014
WO 2015061326 A1 4/2015

OTHER PUBLICATIONS

International Search Report and Written Opinion dated Oct. 31, 2016 for PCT/US2016/016320, filed on Feb. 3, 2016.
2005 Offshore Technology Conference, dated May 5, 2005, pp. 1-5, "Clearing Hyrdate and Wax Blockages in a Subsea FlowLine" DJ Bilyeu et al. XP055312561.

* cited by examiner

SYSTEMS FOR REMOVING BLOCKAGES IN SUBSEA FLOWLINES AND EQUIPMENT

FIELD OF INVENTION

The present invention generally relates to subsea production from oil and gas wells and, more particularly, to unique systems that include a unique blockage remediation skid that is adapted to be mounted to an ROV (Remotely Operated Vehicle) and used to remove blockages, e.g., hydrate blockages, debris blockages, etc., from subsea flowlines and subsea equipment.

BACKGROUND OF THE INVENTION

Production of hydrocarbons (oil and/or gas) from subsea oil/gas wells typically involves positioning several items of production equipment, e.g., Christmas trees, manifolds, pipelines, flowline, skids, pipeline end terminations (PLETs), etc. on the sea floor. Flowlines or jumpers are normally coupled to these various items of equipment so as to allow the produced hydrocarbons to flow between and among such production equipment with the ultimate objective being to get the produced hydrocarbon fluids to a desired end-point, e.g., a surface vessel or structure, an on-shore storage facility or pipeline, etc. Jumpers may be used to connect the individual wellheads to a central manifold. In other cases, relatively flexible lines may be employed to connect some of the subsea equipment items to one another. The generic term "flowline" will be used throughout this application and in the attached claims to refer to any type of line through which hydrocarbon-containing fluids can be produced from a subsea well. As noted above, such flowlines may be rigid, e.g., steel pipe, or they may be somewhat flexible (in a relative sense as compared to steel pipe), e.g., flexible hose.

One challenge facing offshore oil and gas operations involves insuring the flowlines and fluid flow paths within subsea equipment remain open so that production fluid may continue to be produced. The produced hydrocarbon fluids will typically comprise a mixture of crude oil, water, light hydrocarbon gases (such as methane), and other gases such as hydrogen sulfide and carbon dioxide. In some instances, solid materials or debris, such as sand, small rocks, pipe scale or rust, etc., may be mixed with the production fluid as it leaves the well. The same challenge applies to other subsea flowlines and fluid flow paths used for activities related to the production of hydrocarbons. These other flowlines and flow paths could be used to, for example, service the subsea production system (service lines), for injecting water, gas or other mixture of fluids into subsea wells (injection lines) or for transporting other fluids, including control fluids (control lines).

One problem that is sometimes encountered in the production of hydrocarbon fluids from subsea wells is that a blockage may form in a subsea flowline or in a piece of subsea equipment. In some cases the blockage can completely block the flowline/equipment while in other cases the blockage may only partially block the flowline/equipment. For example, the solid materials entrained in the produced fluids may be deposited during temporary production shutdowns, and the entrained debris may settle so as to form all or part of a blockage in a flowline or item of production equipment. Another problem that may be encountered is the formation of hydrate blockages in the flowlines and production equipment.

In general, hydrates may form under appropriate high pressure and low temperature conditions. As a general rule of thumb, hydrates may form at a pressure greater than about 0.47 MPa (about 1000 psi) and a temperature of less than about 21° C. (about 70° F.), although these numbers may vary depending upon the particular application and the composition of the production fluid. Subsea oil and gas wells that are located at water depths greater than a few hundred feet or located in cold weather environments, are typically exposed to water that is at a temperature of less than about 21° C. (about 70° F.) and, in some situations, the surrounding water may only be a few degrees above freezing. Although the produced hydrocarbon fluid is relatively hot as it initially leaves the wellhead, as it flows through the subsea production equipment and flowlines, the surrounding water will cool the produced fluid. More specifically, the produced hydrocarbon fluids will cool rapidly when the flow is interrupted for any length of time, such as by a temporary production shut-down. If the production fluid is allowed to cool to below the hydrate formation temperature for the production fluid and the pressure is above the hydrate formation pressure for the production fluid, hydrates may form in the produced fluid which, in turn, may ultimately form a blockage which may block the production fluid flow paths through the production flowlines and/or production equipment. Of course, the precise conditions for the formation of hydrates, e.g., the right combination of low temperature and high pressure is a function of, among other things, the gas-to-water composition in the production fluid which may vary from well to well. When such a blockage forms in a flowline or in a piece of production equipment, either a hydrate blockage or a debris blockage or a combination of both, it must be removed so that normal production activities may be resumed.

FIG. 1 simplistically depicts one illustrative prior art system and method for removal of such a blockage from subsea flowlines/equipment. In this example, permanent production equipment in form of an illustrative production tree 12, a manifold 15 and a PLET 17 are positioned on the sea floor 13 (e.g., mudline) of a body of water having a surface 11. In this example, a blockage 20 will be depicted as being formed in a flowline 16 between the manifold 15 and the PLET 17. The production fluid flows from the manifold 15 toward the PLET 17, as indicated by the arrow 18 in FIG. 1. As depicted, the blockage 20 has an upstream side 20A and a downstream side 20B. In general, the prior art method involves use of system that includes, among other things, a surface vessel 10, a flowline remediation skid (FRS) 22 positioned on the sea floor 13, an optional chemical storage tank 34, and a subsea hydraulic power unit 24 (SHPU) that is suspended from the vessel 10 by a line 24X. Electrical power and communications maybe provided to the SHPU 24 via the line 24X. In turn, the SHPU 24 may supply power, communication signals and/or pressurized hydraulic fluid to the flowline remediation skid 22 via one or more lines 26. Although not depicted in FIG. 1, the SHPU 24 may also supply power, communication signals and/or pressurized hydraulic fluid to the optional chemical storage tank 34 by another connection line (not shown)

In the example depicted in FIG. 1, the flowline remediation skid 22 is operatively coupled to the manifold 15 by a flexible remediation flow line 28 at connection point 28X, an access point that is upstream of the blockage 20. In other examples, the flowline remediation skid 22 may be operatively coupled to equipment or lines even further upstream of the blockage 20, e.g., the tree 12, or to an access point in the flowline 16 itself (although neither of these situations is depicted in FIG. 1). In some cases, the flowline remediation skid 22 may be operatively coupled to an access point, such as the PLET 17, that is positioned downstream of the blockage 20, as depicted by the dashed-line remediation flow line 28A. The connection 28X between line 28 and the manifold 15 may be a so-called stab-in connection that is commonly employed in subsea equipment to facilitate the connection of a flowline to an item of subsea equipment by use of an ROV. The chemical storage tank 24 (if used) is operatively coupled to the flowline remediation skid 22 by a flexible remediation flow line 36.

The flowline remediation skid 22 is operatively coupled to a plurality of risers 30A-B (e.g., coiled tubing, hose, drill pipe, etc.) that extend from the vessel 10 by a plurality of flexible remediation flow lines 32A-B, respectively. The risers 30A-30B are both adapted to receive lighter fluids and gases (as depicted by the arrows 31) from the outlet of the flowline remediation skid 22, as described more fully below. The term "remediation flow lines" is used throughout this application to indicate that lines 28, 32A-B and 36 are not part of the normal production flowlines used in producing hydrocarbons from the well. Also depicted in FIG. 1 is an illustrative ROV (Remotely Operated Vehicle) 38 that is operatively coupled to the vessel 10 by a simplistically depicted ROV umbilical 40. The ROV 38 is used for, among other things, connecting the various lines 26, 28, 32A-B and 36 among the subsea remediation equipment, e.g., the flowline remediation skid 22, the chemical storage tank 34 (when used) and the SHPU 24, and to observe remediation operations.

As shown in FIG. 2, the flowline remediation skid 22 typically includes a simplistically depicted sump/separator pressure vessel 23. The vessel 23 comprises an upper portion 23A and a sump 23B. The vessel 23 has a process fluid inlet 25 that is adapted to receive production fluid from the manifold 15 and the remnants of the blockage 20 as it is removed. The vessel 23 also comprises first and second process fluid outlets 27A-B whereby relatively lighter fluids and gas (as depicted by the arrows 31) are pumped up the risers 30A-B, respectively, using one or more pumps (not shown) that are part of the flowline remediation skid 22. The sump 23B comprises an outlet 29 whereby solid materials that collect in the sump 23B, e.g., debris and/or portions of the blockage 20, may be removed from the sump 23B when the flowline remediation skid 22 is retrieved to the vessel 10 periodically or after remediation processes are completed. The upper portion 23A of the pressure vessel 23 is sized and designed such that it has sufficient volume to allow for sufficient residence time of the production fluid received into the vessel 23 so that substantially all or a significant portion of the entrained solids (e.g., blockage remnants and/or solids) in the production fluid to fall into the sump 23B. By way of example only, the vessel 23 may be relatively large, e.g., a diameter of about 0.6-1.2 meters (about 2-4 feet) and a length of about 2.4-3 meters (about 8-10 feet) with an internal capacity of about 3.8 $m^3$ about 1000 gallons) or greater. If employed, the chemical storage tank 34 is used to store chemicals, e.g., methanol or other suitable hydrate formation inhibitors, which may be employed in the blockage removal process.

Several techniques have been employed to remove blockages (debris and/or hydrates) from subsea flowlines and subsea production equipment. In the example depicted in FIG. 1, wherein the flowline remediation skid 22 is operatively coupled to the manifold 17, the method may involve first injecting chemicals into an area on the upstream side 20A of the blockage 20 in an attempt to chemically dissolve or soften the blockage 20. Thereafter, efforts are undertaken to reduce the pressure on the upstream side 20A of the blockage 20 by creating a region of relatively low pressure on the upstream side 20A of the blockage 20. The area of low pressure serves at least two purposes. First, by exposing the blockage 20, in this case a hydrate blockage, to a lower pressure on its upstream side 20A that is less than the hydrate formation pressure, all or a part of the blockage 20 may essentially "melt" away (via sublimation). Second, the pressure on the upstream side 20A of the blockage 20 may be reduced in an attempt to create a differential pressure across the blockage 20 (with higher pressure being present on the downstream side 20B of the blockage) so as to force the blockage 20 through the manifold 15 and into the separator/sump vessel 23 on the flowline remediation skid 22. One illustrative prior art method to create this region of low pressure on the upstream side 20A of the blockage 20 is as follows. When the flowline remediation skid 22 is initially lowered to the sea floor 13, the internal pressure within separator/sump vessel 23 may be maintained at a relatively low pressure, e.g., about 0.101 MPA (about 1 atmosphere). At some point after the flowline remediation skid 22 is positioned on the sea floor 13 and coupled to the manifold 15, appropriate valves are actuated such that fluid communication is established between the flowline 16 on the upstream side 20A of the blockage 20 and the separator/sump vessel 23 thereby reducing the pressure in the flowline 16. Once the production fluid, with portions of the removed blockage 20 entrained therein, is introduced into the pressure vessel 23 (via inlet 25—see FIG. 2), substantially all or a significant portion of the entrained solids (e.g., blockage remnants and/or solids) in the production fluid collect and fall into the sump 23B.

One problem with the above prior art system is that, in deep water applications, the density of the production fluid and the resulting back pressure (due to the hydrostatic head) in the lines 30A-30B limit or prevent the ability to reduce pressure in the flowline 16 on the upstream side 20A of the blockage 20 to a sufficiently low level. As a result, it may be difficult to create a low enough pressure region on the upstream side 20A of the blockage 20 such that hydrate sublimation occurs, i.e., it may be difficult to establish a pressure on the upstream side 20A of the blockage 20 that is less than the hydrate formation pressure. Additionally, due to the back pressure (the hydrostatic head in the lines 30A-B) it may not be possible to create enough of a differential pressure across then blockage 20 so as to dislodge or break-up the blockage 20 and force it into the vessel 23 on the flowline remediation skid (FRS) 22

The effectiveness of this prior art method may be limited by several other factors. First, the volume capacity of the pressure vessel 23 may be limited by the depth of the water since the vessel 23 must be designed so as to resist the external pressure on the vessel 23 from the water. All other things being equal, larger diameter vessels 23 are more likely to collapse under external pressure than are small diameter vessels. Accordingly, in applications where the vessel 23 needs a larger capacity, it must be manufactured with thicker walls and/or stiffeners so as to withstand the external pressure of the surrounding water, all of which tend to make it heavier as well as more expensive to manufacture and transport to the offshore well site. Moreover, such a larger pressure vessel 23 may require a surface vessel 10 with enhanced lifting capabilities due to the size and weight of the vessel 23, all of which tend to add to the cost of installing and retrieving the vessel 23 from the sea floor. This is especially true when a larger sump 23B on such a larger vessel 23 is filled with solid materials due to the remediation process. Yet another problem with the prior art system described above is that it consumes significant amounts of valuable plot space on the sea floor 13, especially if the chemical storage tank 34 is employed. This increase in the required overall space on the sea floor 13 space to set the blockage remediation equipment can become problematic in that it may be difficult to position the blockage remediation equipment around the permanently installed subsea production equipment in tightly packed subsea field architectures or in areas where steep slopes are present on the sea floor 13 or geotechnical hazards are prevalent.

A major disadvantage with several prior art systems is that they include hydrate remediation equipment that is installed on the sea floor 13 during remediation operations. This requires that any connections between the surface vessel 10 and the subsea equipment must be rapidly disconnected in case of a loss of position (so called drive-off or drift-off) of the surface vessel 10; otherwise the equipment would be damaged. Additionally, such a situation could even represent a major risk to the integrity of the subsea production system if the equipment on the sea floor 13 is dragged around by the downlines (e.g., 30A, 30B) connected to the moving vessel 10.

The present application is directed to various systems, methods and devices useful in removing blockages, e.g., hydrate plugs, debris plugs, etc., from subsea flowlines and subsea equipment that may eliminate or at least minimize some of the problems noted above.

BRIEF DESCRIPTION OF THE INVENTION

The following presents a simplified summary of the invention in order to provide a basic understanding of some aspects of the invention. This summary is not an exhaustive overview of the invention. It is not intended to identify key or critical elements of the invention or to delineate the scope of the invention. Its sole purpose is to present some concepts in a simplified form as a prelude to the more detailed description that is discussed later.

In one embodiment, the present application is generally directed to blockage remediation system for removing blockages, e.g., hydrate plugs, debris plugs, etc., from subsea flowlines and subsea equipment. In one illustrative embodiment, the system includes, among other things, an ROV deployed into a body of water from a surface vessel and a blockage remediation skid that is operatively coupled to the ROV, wherein the skid includes at least a skid fluid inlet and a skid fluid outlet. The system also includes a returns downline and a pressurized lift-gas supply downline that extends into the body of water from the vessel. The returns downline is operatively coupled to the skid fluid outlet, while the pressurized lift-gas supply downline is adapted to be operatively and directly coupled to the blockage remediation skid or operatively and directly coupled to the returns downline. The system also includes a remediation flow line that is operatively coupled to the skid fluid inlet and a subsea flowline or an item of subsea equipment.

In another illustrative embodiment, the present application is also directed to blockage remediation skid that is adapted to be mounted to an ROV wherein the remediation skid is useful in removing blockages, e.g., hydrate plugs, debris plugs, etc., from subsea flowlines and subsea equipment. In one illustrative embodiment, the skid includes, among other things, a skid fluid inlet, a skid fluid outlet (that is adapted to be placed in fluid communication with a returns downline from a surface vessel) and a skid pressurized lift-gas inlet (that is adapted to be placed in fluid communication with a pressurized lift-gas supply downline from the surface vessel. The skid also includes a process vessel that is adapted to receive a production fluid from a subsea flowline or an item of subsea equipment wherein production fluid introduced in to the process vessel is adapted to be introduced into the returns downline via the skid fluid outlet.

BRIEF DESCRIPTION OF THE DRAWINGS

The present invention will be described with the accompanying drawings, which represent a schematic but not limiting its scope.

Figure 1:
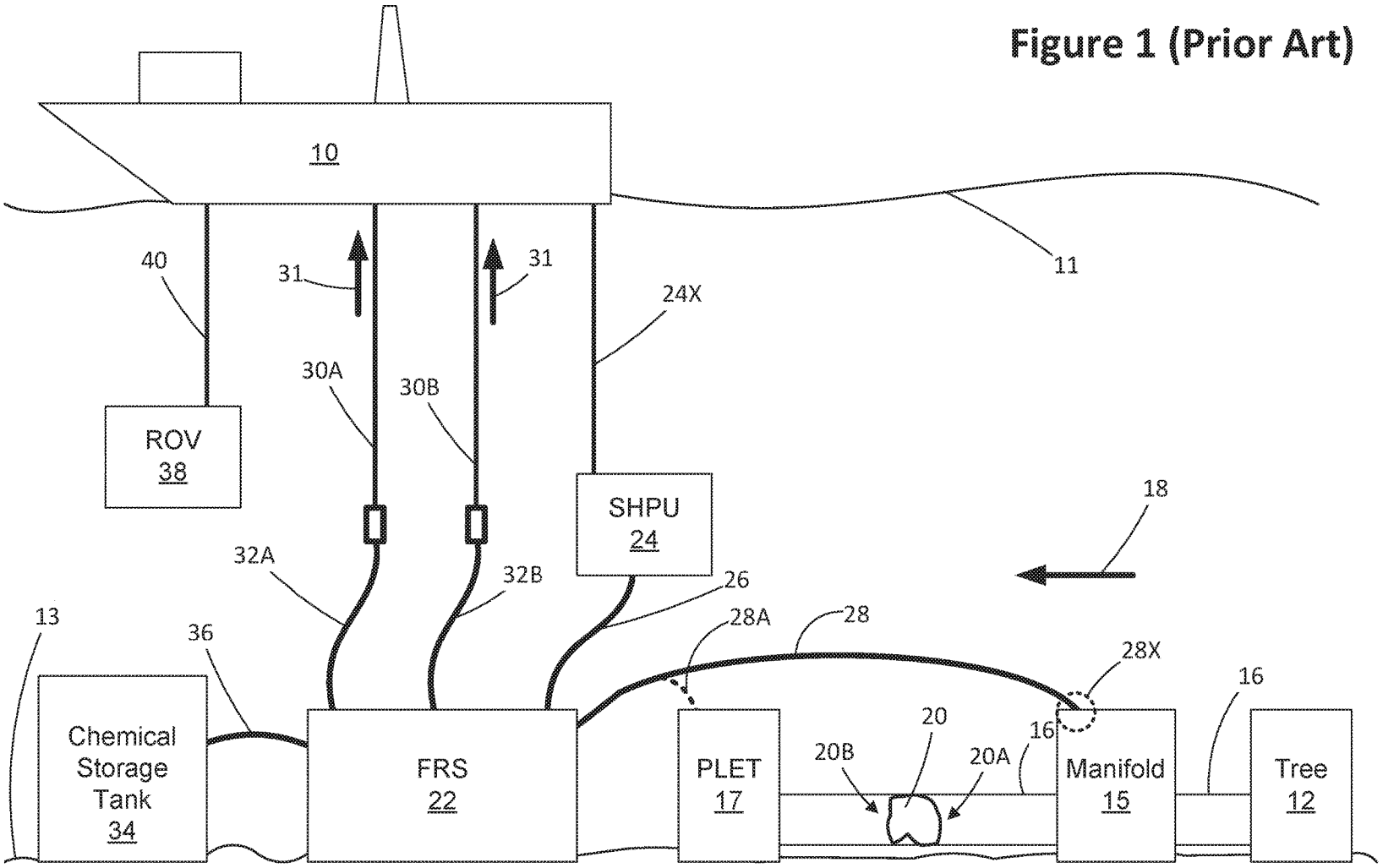
Figure 1 (Prior Art)
FIGS. 1 and 2 depict one illustrative prior art system that may be employed to remove blockages, e.g., hydrate plugs, debris plugs, etc., from subsea flowlines and subsea equipment.

While the subject matter disclosed herein is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE INVENTION

Various illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The present subject matter will now be described with reference to the attached figures. Various structures, systems and devices are schematically depicted in the drawings for purposes of explanation only and so as to not obscure the present disclosure with details that are well known to those skilled in the art. Nevertheless, the attached drawings are included to describe and explain illustrative examples of the present disclosure. The words and phrases used herein should be understood and interpreted to have a meaning consistent with the understanding of those words and phrases by those skilled in the relevant art. No special definition of a term or phrase, i.e., a definition that is different from the ordinary and customary meaning as understood by those skilled in the art, is intended to be implied by consistent usage of the term or phrase herein. To the extent that a term or phrase is intended to have a special meaning, i.e., a meaning other than that understood by skilled artisans, such a special definition will be expressly set forth in the specification in a definitional manner that directly and unequivocally provides the special definition for the term or phrase.

Figure 2:
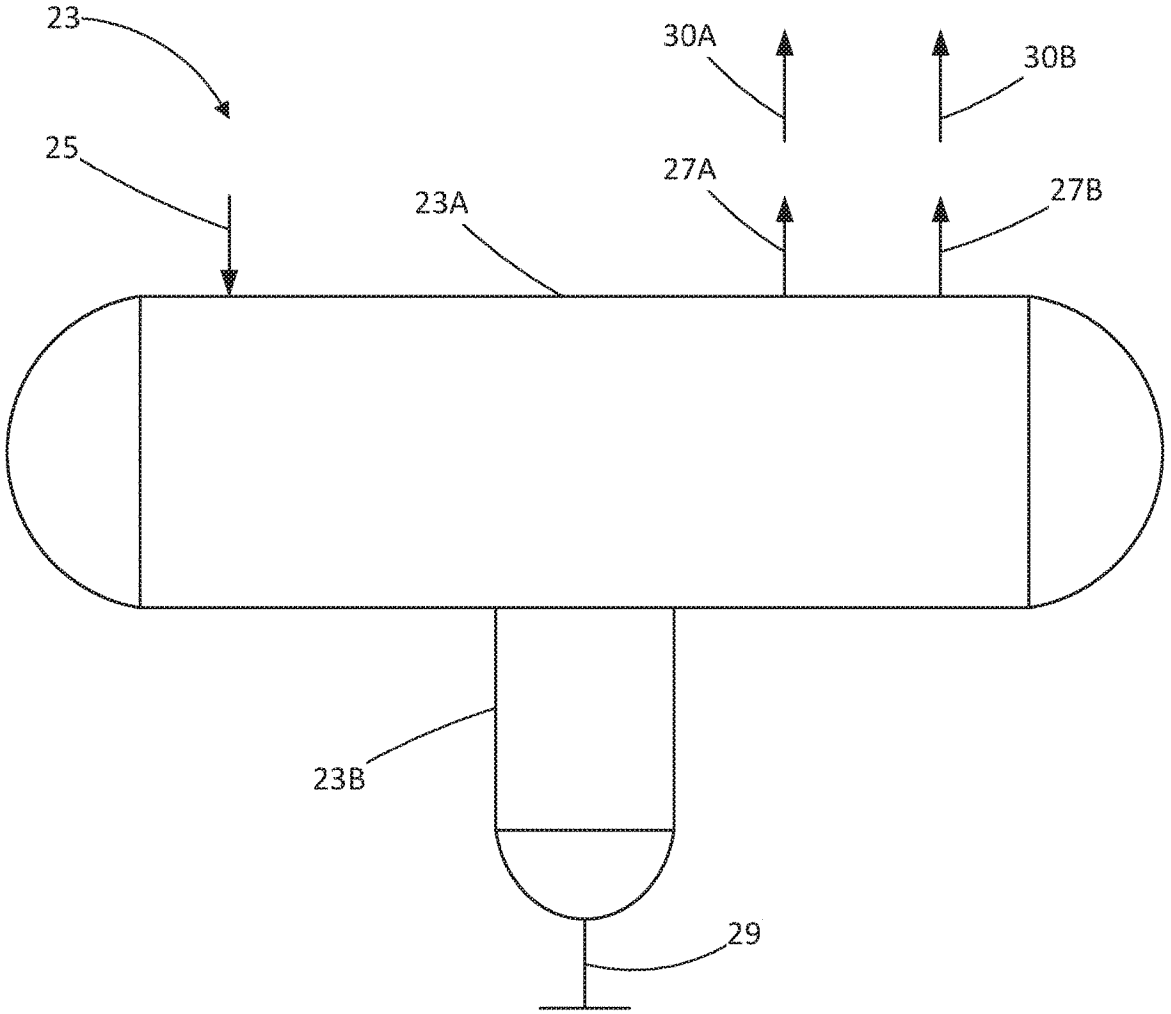
Figure 2 (Prior Art)

FIGS. 3-10 depict various novel systems, methods and devices useful in removing blockages, e.g., hydrate plugs, debris plugs, etc., from subsea flowlines and subsea equipment. As described more fully below, the systems 100 includes various novel devices and such systems enable the performance of various novel methods to remove blockages from subsea flowlines and equipment as described more fully below. FIGS. 3-10 may include references to certain items previously described in FIGS. 1 and 2 above.

Figure 3:
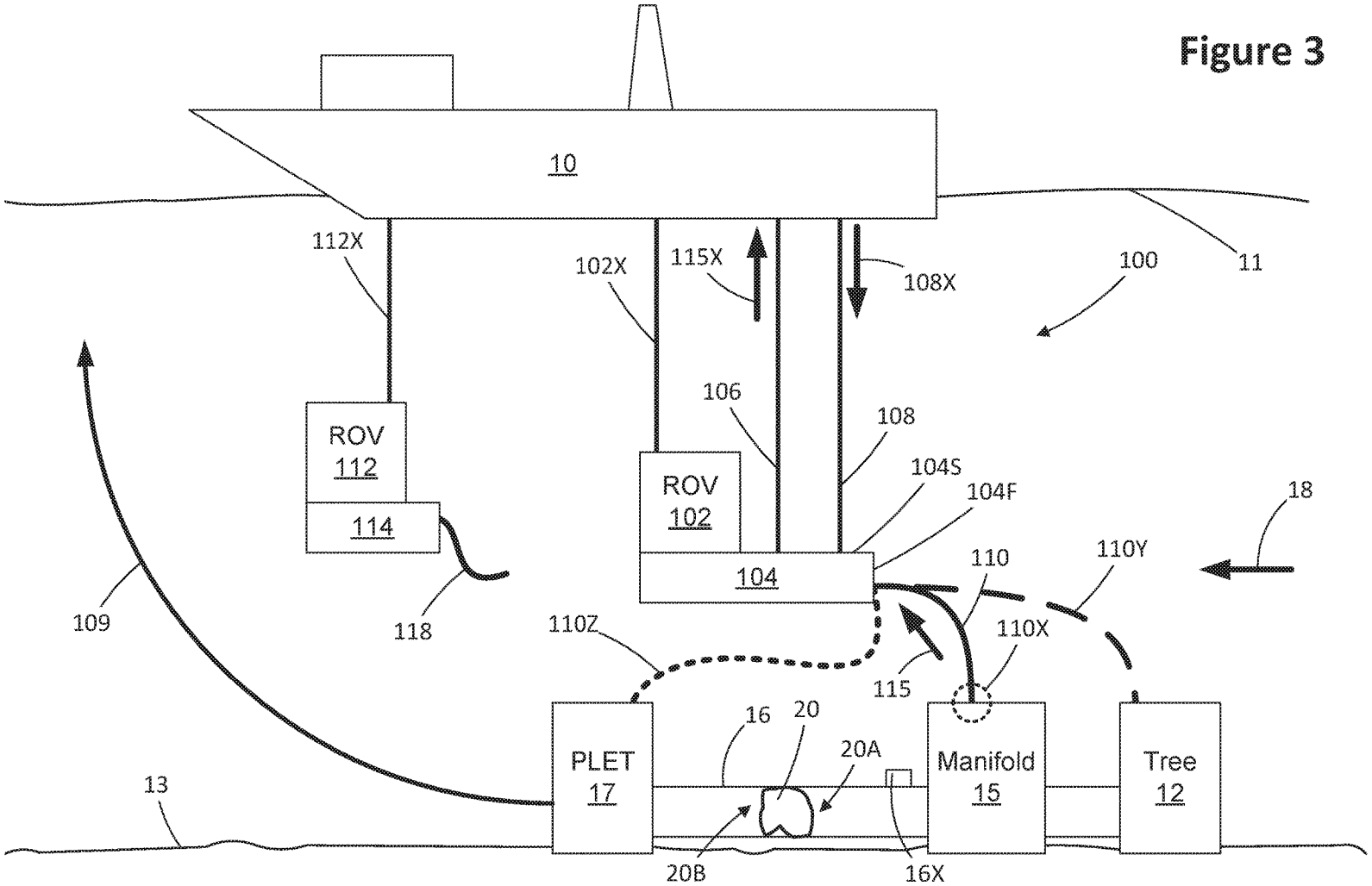
FIG. 3 depicts one illustrative embodiment of a novel system disclosed herein that is useful in removing blockages, e.g., hydrate plugs, debris plugs, etc., from subsea flowlines and subsea equipment.

FIG. 3 depicts one illustrative embodiment of a novel blockage remediation system 100 disclosed herein that may be used to remove the illustrative blockage 20 (described previously above) positioned in the illustrative flowline (defined above) 16 positioned between the two illustrative items of subsea equipment, i.e., the manifold 15 and the PLET 17. As before, the production fluid flows in the direction indicated by the arrow 18. In general, the system comprises a first ROV 102, and a blockage remediation skid 104 that is operatively coupled to the ROV 102. The ROV 102 is operatively coupled to the surface vessel 10 by a schematically depicted ROV umbilical 102X. The ROV 102 contains a power supply system for powering the functions of the ROV 12 and for supplying power and communication lines to the blockage remediation skid 104.

In the example depicted in FIG. 3, the blockage remediation skid 104 is adapted to be directly and operatively coupled to a pressurized lift-gas supply line 108 (e.g., a downline from the vessel 10) whereby a pressurized non-volatile lift-gas 108X, such as nitrogen, is provided from the vessel 10 to the blockage remediation skid 104 for reasons that will be discussed more fully below. The pressurized lift-gas 108X is supplied from facilities on the vessel 10, e.g., a compressor and a stored supply of lift-gas. The pressure of the pressurized lift-gas 108X as well as the flow rate of the pressurized lift-gas 108X may vary depending upon the particular application, e.g., in one illustrative embodiment, it may be supplied at a pressure that falls within the range of about 20.6-34.5 MPa (about 3000-5000 psi), and its flow rate may be on the order of about 9.9-56.7 $m^3$/min (about 350-2000 $ft^3$/min).

The blockage remediation skid 104 is also adapted to be operatively coupled to a returns downline 106 from the vessel 10, whereby production fluid 115X, that includes pressurized lift-gas 108X and remnants of a blockage 20 that is removed, is sent to the vessel 10 as the blockage remediation process is performed, as described more fully below. Facilities are provided on the vessel 10 to receive and store or further process the production fluid 115X.

The blockage remediation skid 104 also includes a remediation flow line 110 that is adapted to be coupled to an access point on a subsea flowline or an item of subsea equipment at any desired location either on the upstream side 20A of the blockage 20 or on the downstream side 20B of the blockage 20. In the example depicted in FIG. 3, the remediation flow line 110 is operatively coupled to the manifold 15 (a location on the upstream side 20A of the blockage 20), such that production fluid 115 may be supplied to the blockage remediation skid 104 via the manifold 15. As depicted by the dashed remediation flow line 110Y, the blockage remediation skid 104 may be operatively coupled to an access point even further upstream of the blockage 20, e.g., the tree 12. If desired, as depicted by the dashed remediation flow line 110Z, the blockage remediation skid 104 may be operatively coupled to an access point (e.g., the PLET 17) that is positioned on the downstream side 20B of the blockage 20. In this configuration, the system 100 can be used to reduce or increase the pressure on the downstream side 20B of the blockage 20 as described more fully below. The various connections between the blockage remediation skid 104 and the flowline or subsea equipment, e.g., the connection 110X between the remediation flow line 110 and the manifold 15 may be a so-called stab-in connection that is commonly employed in subsea equipment to facilitate the connection of a flowline to the equipment or flowline 16 by use of an ROV.

Figure 4:
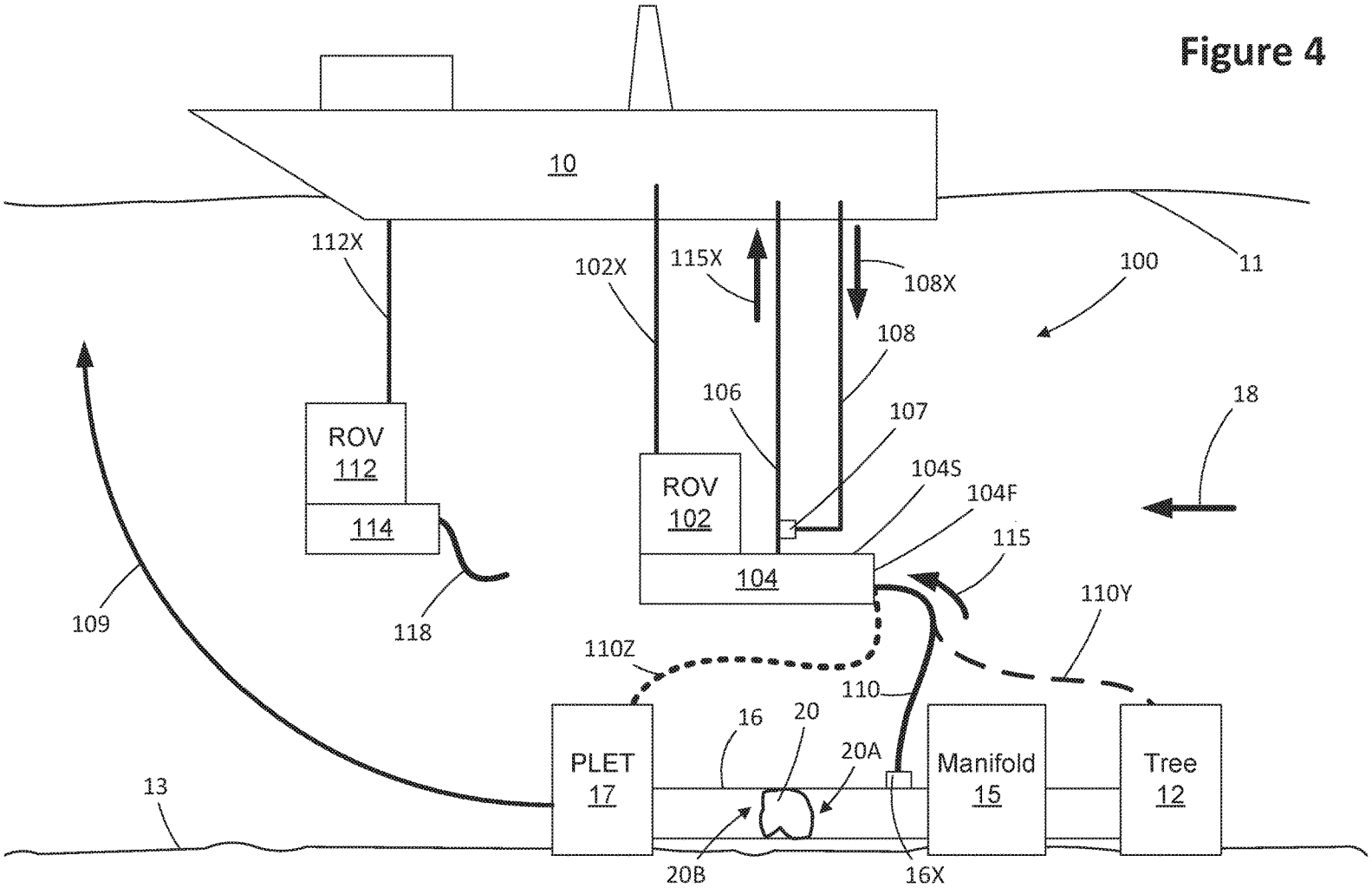
FIG. 4 depicts another illustrative embodiment of a novel system disclosed herein that is useful in removing blockages, e.g., hydrate plugs, debris plugs, etc., from subsea flowlines and subsea equipment.

FIG. 4 depicts another version of the novel blockage remediation system 100 disclosed herein that may be used to remove the illustrative blockage 20 in the flowline 16. Relative to the system 100 depicted in FIG. 3, in the system 100 shown in FIG. 4, the pressurized lift-gas supply line 108 is directly coupled to the returns line 106 via an illustrative access point 107 (e.g., a teed inlet) into the returns line 106 at a location that is relatively near the bottom of the returns line 106. That is, in the embodiment shown in FIG. 4, unlike the system shown in FIG. 3, the pressurized lift-gas supply line 108 is not directly coupled to the blockage remediation skid 104. In the system shown in FIG. 4, the flow rate and pressure of the pressurized lift-gas 108X that is introduced into the returns line 106 may be controlled by an operator on the vessel 10. Additionally, in the system shown in FIG. 4, the remediation flow line 110 is operatively coupled to an access point 16X on the flowline 16 (a location on the upstream side 20A of the blockage 20), such that production fluid 115 may be supplied to the blockage remediation skid 104 via the access point 16X. Of course, the system in FIG. 4 may be operatively coupled to the flowline 16 and/or the tree 12, the manifold 15 or the PLET 17 as described above with reference to FIG. 3. As will be appreciated by those skilled in the art after a complete reading of the present application, the blockage remediation systems 100 described herein could be operatively coupled to any connection point on any item of subsea equipment or a flowline. For example, either of the systems 100 could be operatively coupled to a jumper between the tree 12 and the manifold 15, to the connection point or the manifold 15, to a connection point 16X on the flowline 16, or to a connection point on a pipeline downstream of the PLET, for example, a pipeline or riser 109 (as shown in FIGS. 3 and 4), which is for the purposes of the inventions disclosed herein is to be considered as a flowline).

The systems 100 in both FIGS. 3 and 4 may also include a second ROV 112 that is operatively coupled to the vessel 10 by a schematically depicted ROV umbilical 112X. In some application, the second ROV 112 may include a chemical supply skid 114 that includes one or more chemicals, e.g., methanol, that may be useful in performing the blockage remediation processes disclosed herein. A line 118 that is in fluid communication with the chemical supply skid 114 on the second ROV 112 may be operatively coupled to the blockage remediation skid 104 on the first ROV 102 such that chemicals may be employed in the blockage remediation processes described more fully below. However, it should be understood that the chemical supply skid 114 may not be required in all applications. In some cases, chemicals that may be used in removing the blockage 20 may be available from some of the items of subsea equipment positioned on the sea floor 13, such as the production tree 12. The second ROV 112 may also be employed to establish the various connections between the blockage remediation skid 104 and the vessel 10 as well that the connection between the blockage remediation skid 104 and the subsea equipment and/or flowline. Of course, as will be appreciated by those skilled in the art after a complete reading of the present application, the systems 100 described in FIGS. 3 and 4 can, in at least some applications, be effectively installed and operated with the use of only a single ROV 102.

Figure 6:
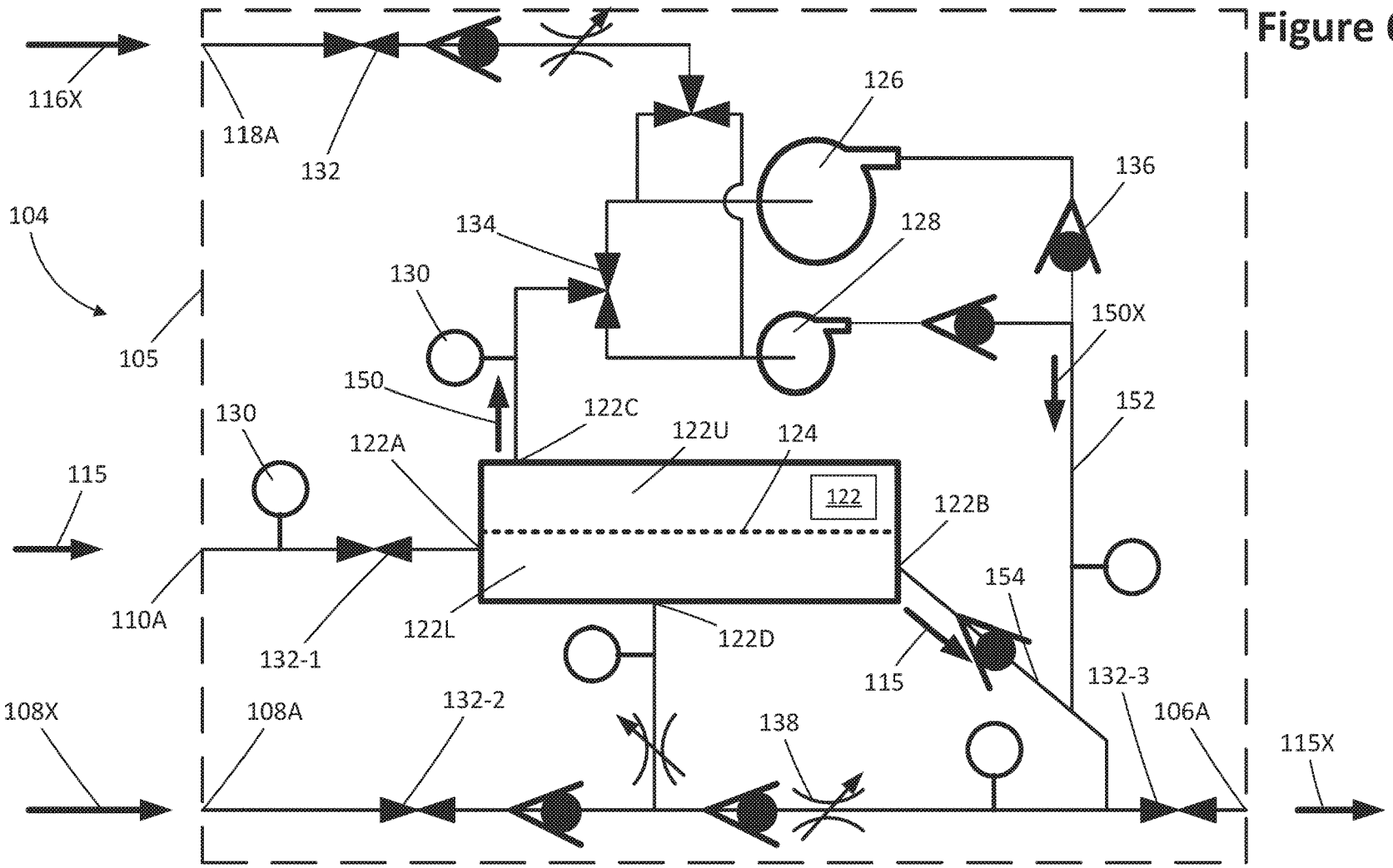
FIGS. 6-6E are figures that include a simplistic process flow diagram of one illustrative embodiment of a novel blockage remediation skid that may be used in the system disclosed herein to remove blockages, e.g., hydrate plugs, debris plugs, etc., from subsea flowlines and subsea equipment as well as possible flow path configurations that may be established using the unique valving and systems configurations disclosed herein.
Figure 6A:
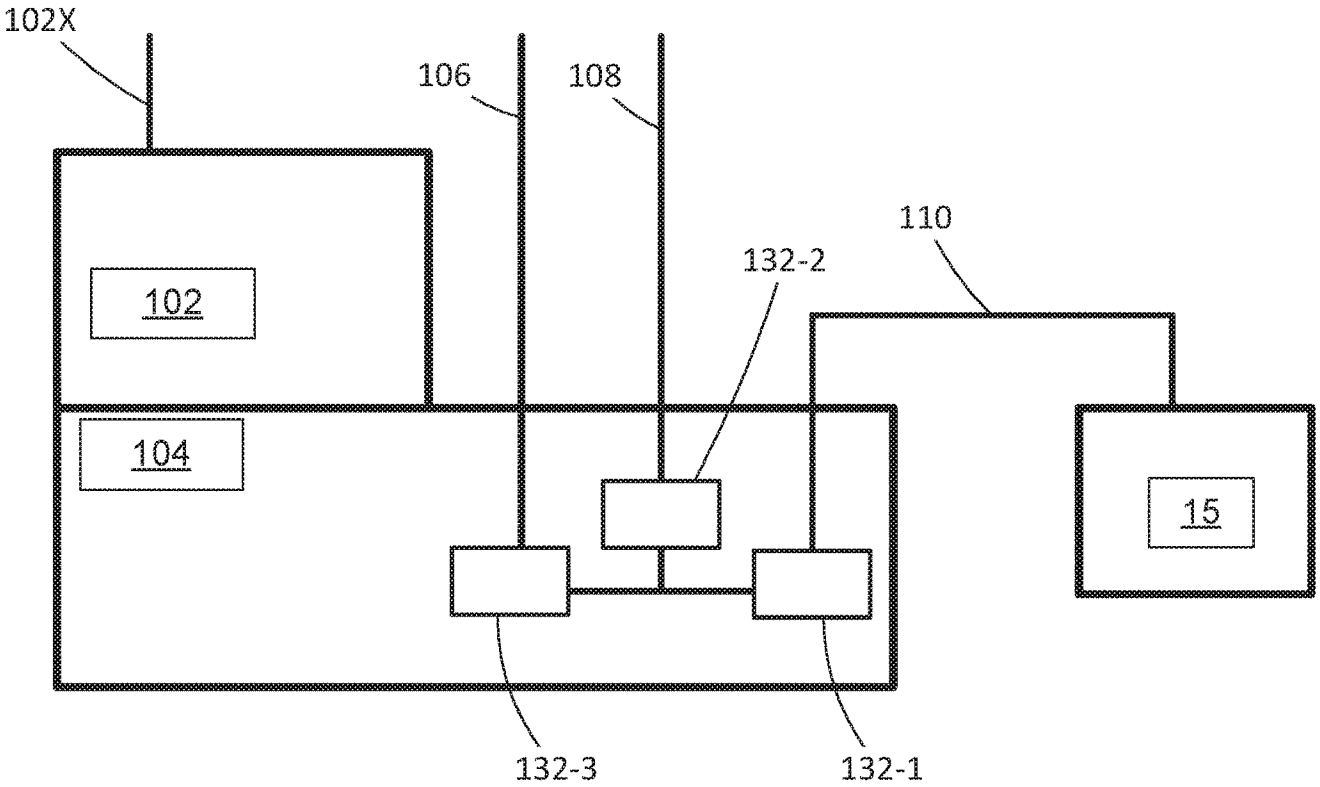
Figure 6B:
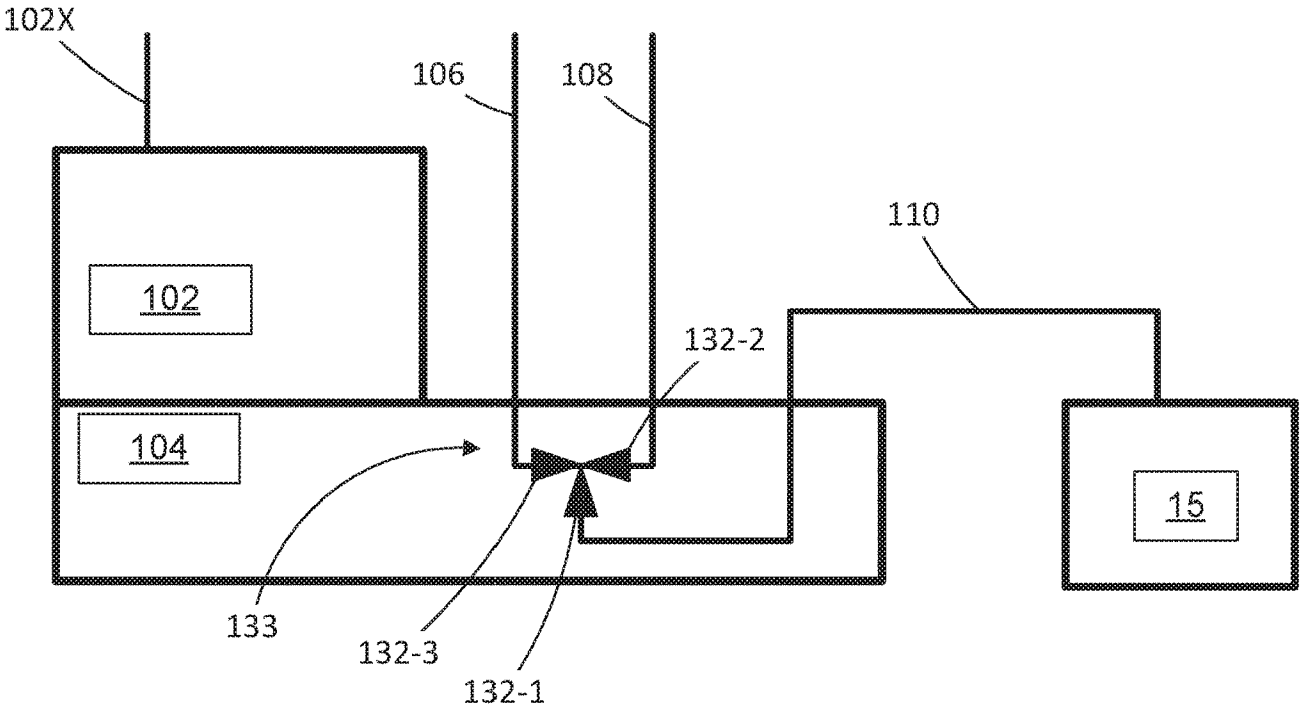
Figure 6C:
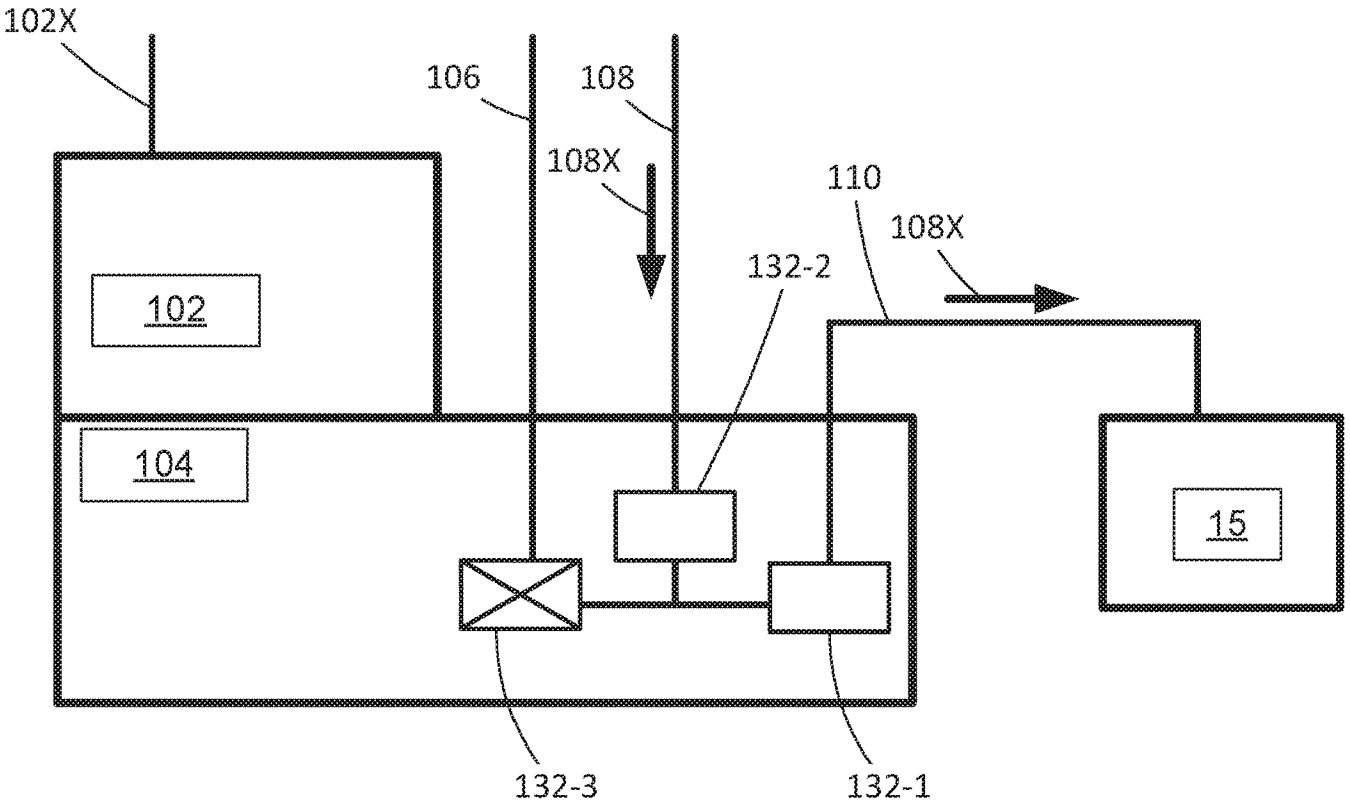
Figure 6D:
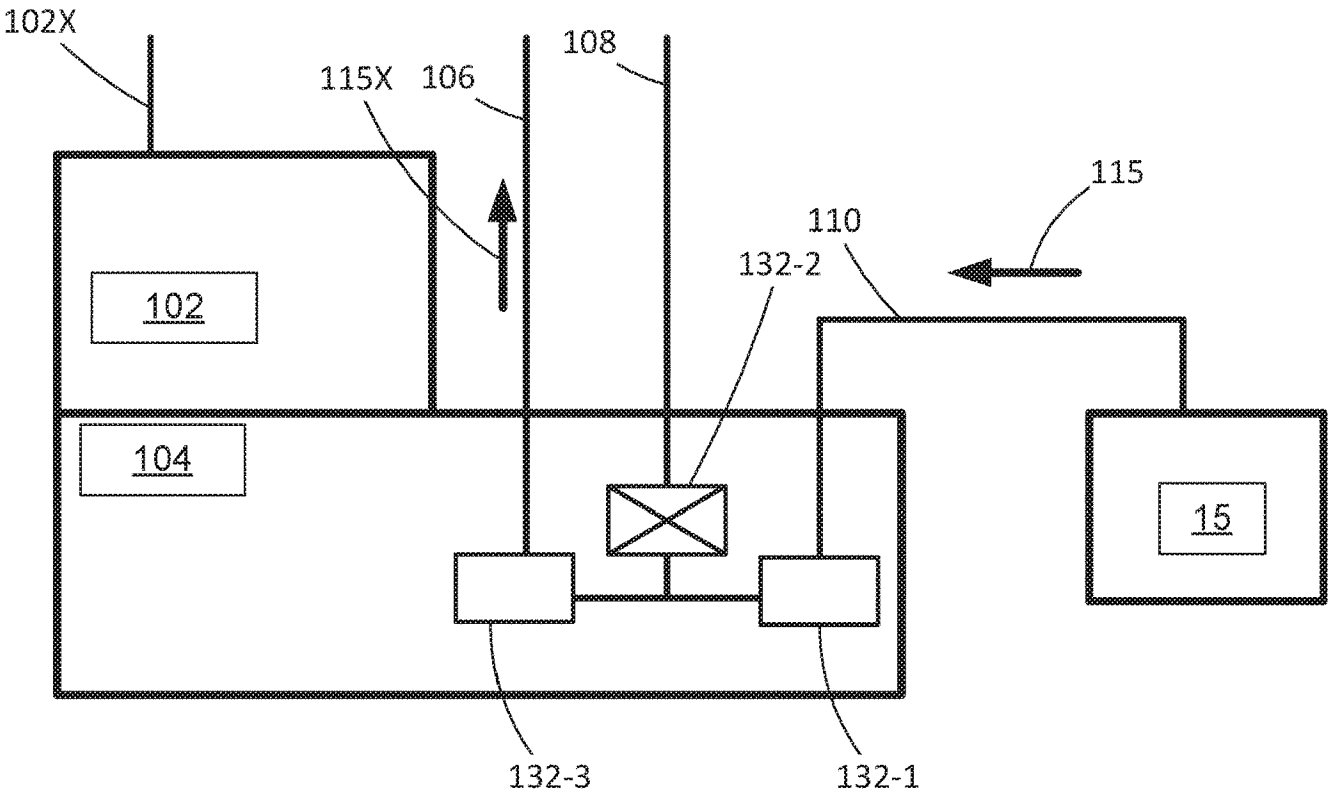
Figure 6E:
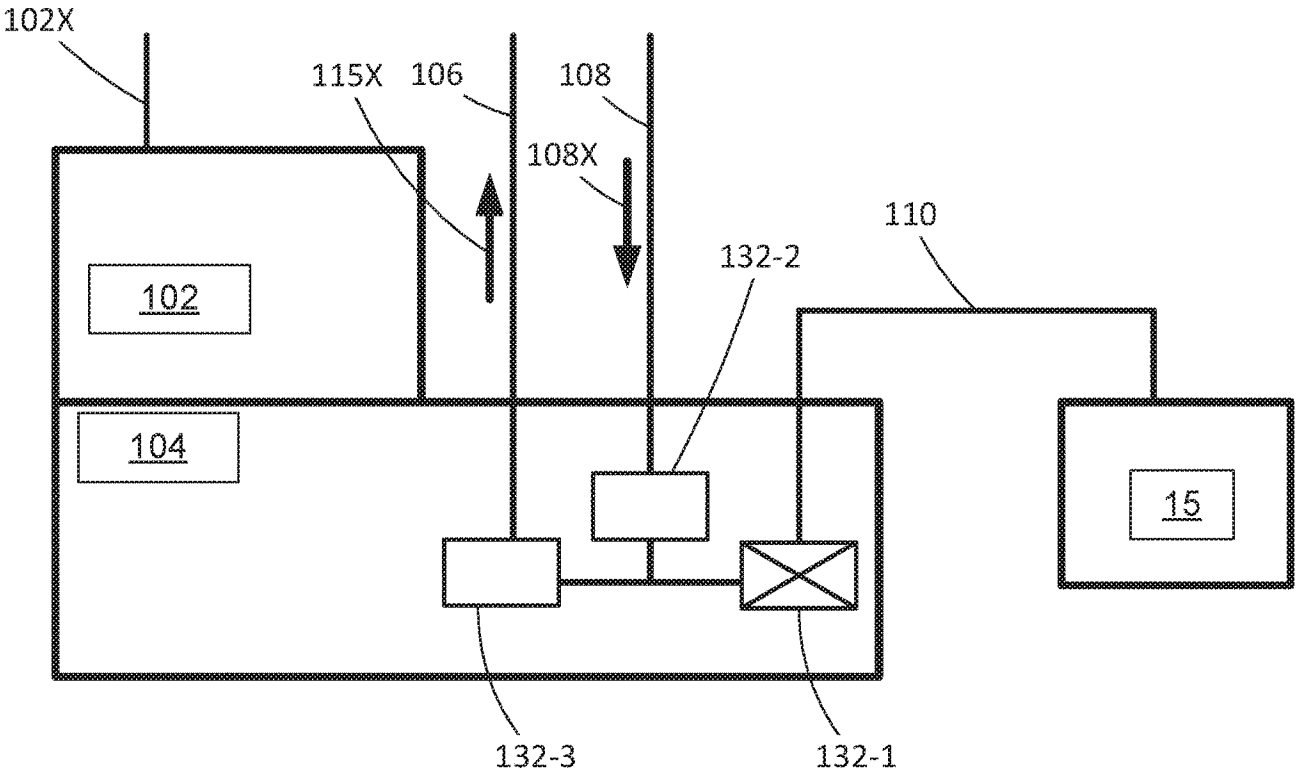

With continuing reference to FIG. 6-6E, the systems 100 include a unique arrangement of valves that provide an operator with the capability of defining various process flow paths of the various process streams so as to achieve various desired operational configurations and objectives. In the examples depicted in FIGS. 6 and 6A, the system comprises a plurality of individual valves: a production fluid valve 132-1 (for receiving production fluid 115), a pressurized lift-gas valve 132-2 (for receiving pressurized lift-gas 108X) and a returns line valve 132-3 (for receiving production fluid 115X that contains entrained remnants of the blockage 20) and controlling the flow of the fluid 115X into the returns line 106. All of these valves (132-1, 132-2, and 132-3) need not be physically located on the blockage remediation skid 104 in all applications, although such a configuration may be implemented if desired. All of these valves, as well as any other valve that is on or near the skid 104, can be operated by the control system on the ROV 102 via the skid 104 and/or manually operated by the manipulator arm on the ROV 102 or the manipulator arm on the ROV 112. These valves may take the form of individual valves, as depicted in FIGS. 6 and 6A or they may be combined as part of a multiple-way valve, such as the illustrative 3-way valve 133 shown in FIG. 6B. In the discussion below, reference will be made to the illustrative example where the valves 132-1, 132-2 and 132-3 are each individual valves, but the discussion below is equally applicable to the example where the these valves are part of the 3-way valve 133 depicted in FIG. 6B.

With reference to FIG. 6C, among other fluid flow paths, these valves may be selectively configured to establish a first flow path whereby pressurized lift-gas 108X may flow down the pressurized lift-gas line 108 and into the remediation flow line 110 while the returns downline 106 is closed (at or near the skid 104). More specifically, this first flow path may be established by opening the valves 132-1 and 132-2 and closing the valve 132-3. With reference to FIG. 6D, these valves may also be selectively configured to establish a second flow path whereby production fluid 115 that is received into the remediation flow line 110 (e.g., by accessing the manifold 15 or the access point 16X) may flow into the returns downline 106 (as part of the production fluid 115X that contains remnants of the blockage 20) while the pressurized lift-gas line 108 is closed (at or near the skid 104). This second flow path may be established by opening the valves 132-1 and 132-3 and closing the valve 132-2. As yet another example, with reference to FIG. 6E, these valves may also be selectively configured to establish yet a third flow path whereby pressurized lift-gas 108X may flow down the pressurized lift-gas line 108 and into the returns downline 106 while the remediation flow line 110 is closed (at or near the skid 104). This third flow path may be established by opening the valves 132-2 and 132-3 and closing the valve 132-1.

Figure 5:
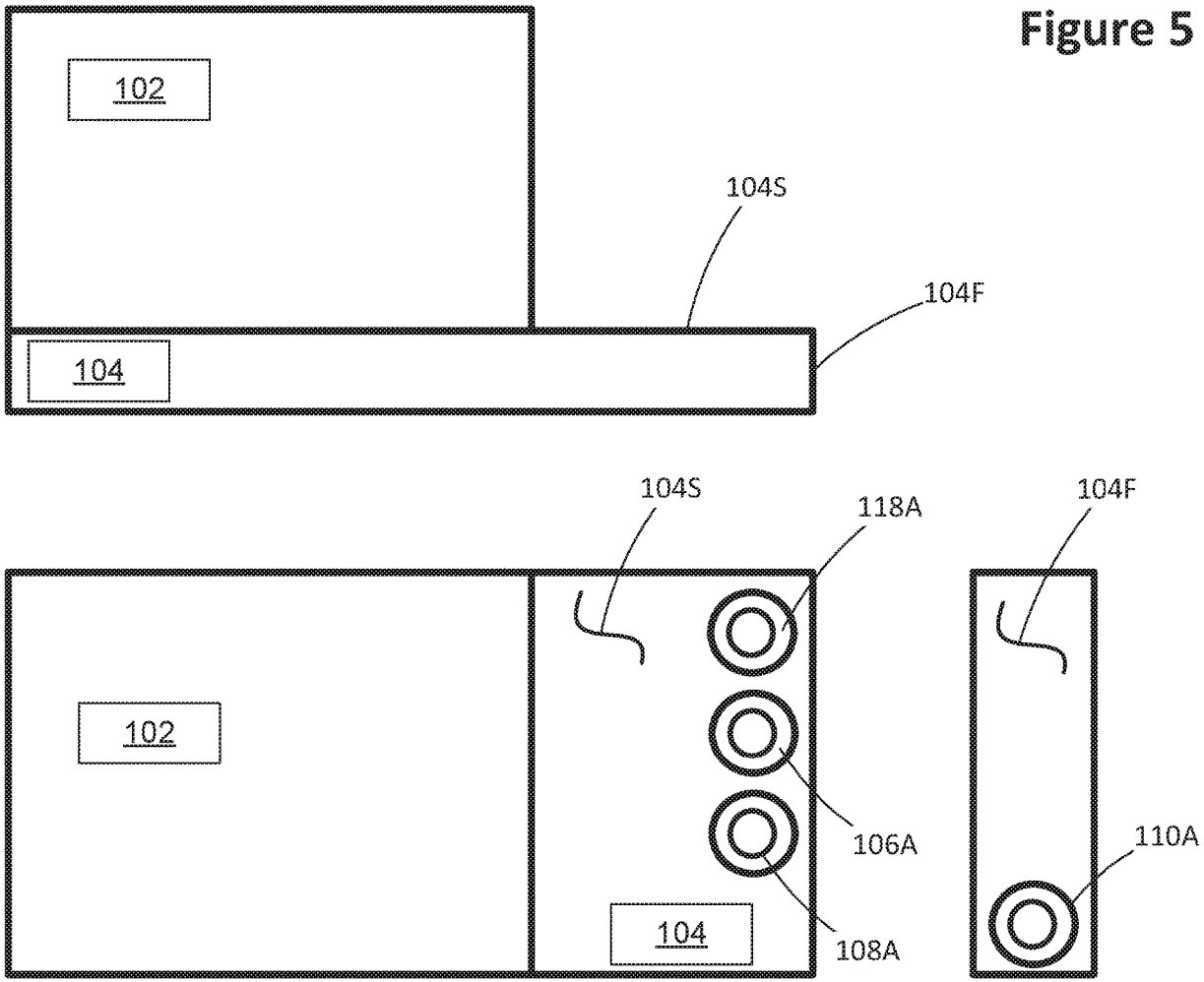
FIG. 5 depicts various views of an embodiment of a blockage remediation skid 104 that is operatively mounted on an ROV.

FIG. 5 contains various views of the ROV 102 and the blockage remediation skid 104 so as to show some illustrative examples of where various inlet and outlet connections to the blockage remediation skid 104 may be made. In general, the blockage remediation skid 104 will have an outer housing (or outer shell) with an upper surface 104S and a front surface 104F. Of course, the various connections described herein may be positioned at any desired location on the blockage remediation skid 104. As depicted, in one example, the blockage remediation skid 104 includes a skid pressurized lift-gas inlet 108A that is adapted to be coupled to the pressurized lift-gas downline 108 from the vessel 10 such that pressurized lift-gas 108X may be supplied from the vessel 10 to the blockage remediation skid 104. The blockage remediation skid 104 also comprises a skid production fluid outlet connection 106A whereby production fluid 115X (with entrained lift-gas 108X and remnants of the blockage 20 therein) is returned to the vessel 10 via the returns downline 106 during the blockage remediation process. Also depicted is a skid production fluid inlet 110A in the front face 104F of the blockage remediation skid 104. The skid production fluid inlet 110A is adapted to be in fluid communication (via line 110) with the subsea production equipment or flowline 16 such that production fluid 115 (with entrained remnants of the blockage 20 therein) is supplied to the blockage remediation skid 104 during the blockage remediation process. The blockage remediation skid 104 may also include a skid chemical inlet 118A that is adapted to be coupled to the line 118 from the chemical supply skid 114 (when employed) such that chemicals may be employed in the blockage remediation process as described more fully below. In the system depicted in FIG. 4, the skid pressurized lift-gas inlet 108A may not be included on the blockage remediation skid 104. The various connections to the blockage remediation skid 104 may be so-called stab-in connections that are commonly employed in subsea equipment to facilitate the connection of a flowline to the equipment by use of an ROV.

FIG. 6 is a simplistic process flow diagram for one illustrative embodiment of a blockage remediation skid 104 disclosed herein. In one embodiment, all of the equipment positioned within the dashed line 105 may be part of the blockage remediation skid 104. In general, one illustrative embodiment of the blockage remediation skid 104 includes a process vessel 122, a baffle plate 124 positioned within the process vessel 122 and a plurality of pumps 126, 128. The blockage remediation skid 104 also includes various process control instruments and devices for controlling, directing and regulating the flow of various fluids and gases to, from and within the blockage remediation skid 104. More specifically, such process control instruments and devices may include one or more pressure sensors 130, valves 132, three-way valves 134, check valves 136 and chokes 138 that are positioned as depicted in the various flow lines that are part of this illustrative embodiment of the blockage remediation skid 104. The size of the process control instruments and devices may vary depending upon the particular application. Of course, other possible fluid flow path configurations are possible so as to achieve the desired purposes stated herein. Although optional, if desired, a line may be included within the blockage remediation skid 104 such that chemicals 116X (if available) may be supplied to the production fluid 115 after it enters the blockage remediation skid 104 via the skid production fluid inlet 110A. Such chemicals may also be supplied to the lines containing the fluid 150 entering the pumps 126, 128 so as to lessen the likelihood of hydrate formation in those lines when the pumps 126, 128 are operational.

In general, the blockage remediation skid 104 is of a size and weight such that it may be operatively coupled to the ROV 102. All of the components of the blockage remediation skid 104 may be mounted on a framework of structural components (not shown) and it may be covered with an outer shell or housing, e.g., stainless steel. In one example, the blockage remediation skid 104 may be in the form of a box-like structure having a length of about 4.3 meters (about 14 feet), an overall width of about 2.4 meters (about 8 feet) and an overall height of about 0.6 meters (about 2 feet). Of course, these dimensions may change depending upon the particular application and the size and capabilities of the ROV 102. The blockage remediation skid 104 will also include ballast to increase its buoyancy in water and thereby decreases its effective weight when positioned in the water. The blockage remediation skid 104 also includes standardized connections (not shown) that permit structures to be operatively coupled to an ROV. The blockage remediation skid 104 is operatively coupled to the ROV 102 so that, among other things, electrical power and control signals may be supplied to the blockage remediation skid 104 via the ROV 102 and various control signals from the instruments in the blockage remediation skid 104 may be observed and acted upon by operators of the ROV 112 on the vessel 10 during blockage remediation operations. As will be appreciated by those skilled in the art after a complete reading of the present application, once assembled, the blockage remediation skid 104 may be shipped anywhere in the world and coupled to an ROV that may be separately sent to the job location.

Figure 7:
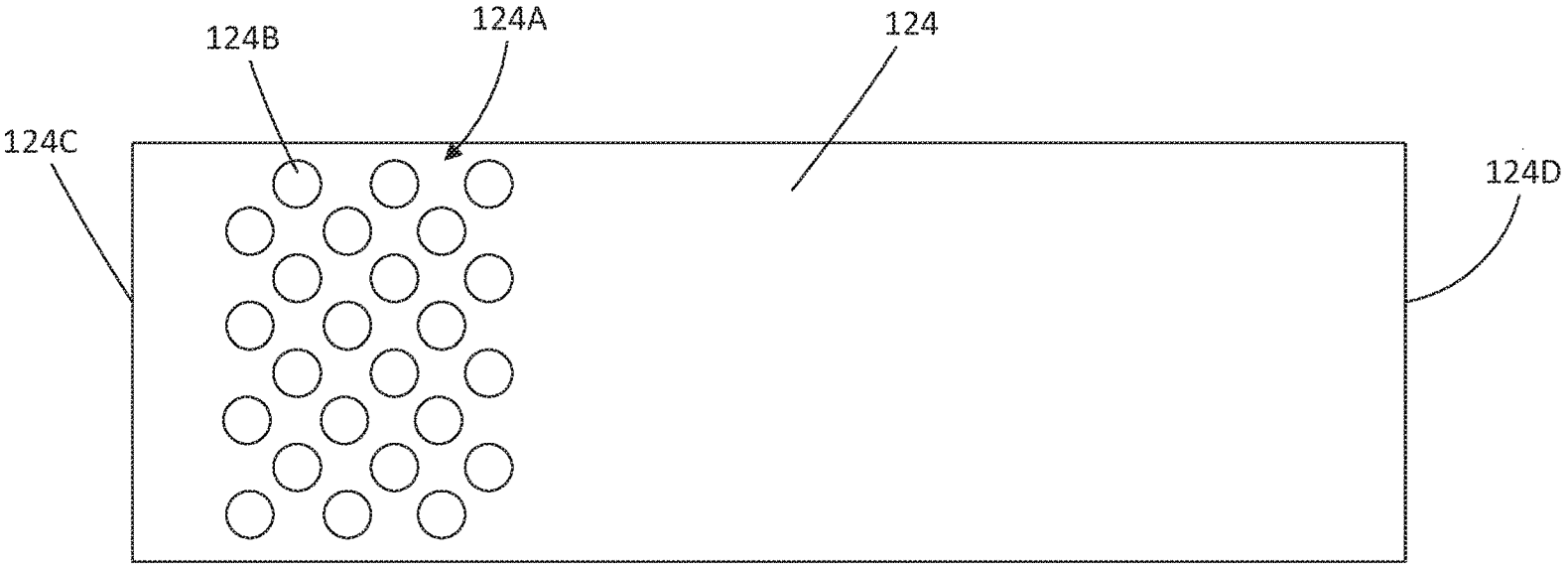
FIG. 7 is a plan view of an illustrative baffle plate that may be incorporated as part of a process vessel that may be included as part of one illustrative embodiment of a blockage remediation skid disclosed herein.

FIG. 7 simplistically depicts a plan view of one illustrative embodiment of a baffle plate 124 that is positioned within the process vessel 122. With reference to FIG. 6, the baffle plate 124 essentially divides the process vessel 122 into an upper chamber 122U and a lower chamber 122L. As shown in FIG. 7, the baffle plate 124 comprises a plurality of openings 124A positioned adjacent one end 124C of the baffle plate 124 while the other end 124D of the baffle plate is free of such openings 124A. The number, size, configuration and positioning of the openings 124A, as well as the area of the baffle plate 124 covered by the openings 124A, may vary depending upon the particular application. In the depicted example, the openings 124A are holes 124B that are drilled through the baffle plate 124. In one example, the holes may have a diameter on the order of about 3.2-6.4 mm (about 0.125 to 25inch). In general, and as described more fully below, the baffle plate 124, with the openings 124A therein, is provided so as to a remove some of the entrained solid materials (e.g., blockage 120 remnants and debris) from the production fluid 115 so as to provide a relatively clean process fluid 150, e.g., a fluid stream that is free of a substantial portion of the solid materials entrained in the production fluid 115 when it enters the vessel 122, to the pumps 126, 128. This is accomplished by allowing the production fluid 115 (with the entrained solids) to flow through the relatively small openings 124A in the baffle plate 124 and into the upper chamber 122U of the vessel 122 which tends to remove a significant amount of the entrained solids in the production fluid 115. Any solids removed by this process fall into the lower chamber 122L of the vessel and are re-entrained in the process fluid 115 as it flows through the lower chamber 122U.

With continuing reference to FIG. 6, the process vessel 122 includes a vessel production fluid inlet 122A whereby production fluid 115 (with entrained materials from the blockage 120 as the blockage removal process is performed) is introduced into the lower chamber 122L. The process vessel 122 also includes a vessel production fluid outlet 122B whereby production fluid 115 from the lower chamber 122L flows out of the vessel 122. The production fluid 115 leaving the vessel 122 includes entrained materials from the blockage 120 (as the blockage removal process was performed) as well as additional entrained solids from the fluid cleaning process described above as the production fluid 115 flows through the openings 124A in the baffle plate 124. The process vessel 122 also includes a vessel clean fluid outlet 122C whereby relatively solids-free production fluid 150 is supplied to the pumps 126, 128. The process vessel 122 may also include a vessel lift-gas inlet 122D whereby lift-gas may be supplied to the lower chamber 122L of the vessel 122.

As will be appreciated by those skilled in the art after a complete reading of the present application the process vessel 122 is not designed or configured as a separator/sump type vessel like the vessel 23 (see FIG. 2) disclosed in the background section of this application. That is, the process vessel 122 on board the blockage remediation skid 104 does not include a sump (like the sump 23B shown in FIG. 2). Additionally, the process vessel 122 is not sized nor configured so as to provide a significant residence time for the process fluid 115 to be present in the vessel 122 such that solid material entrained in the process fluid 115 may settle-out by virtue of gravitational forces. Rather, in the systems and devices disclosed herein, the process fluid 115 (with entrained solids materials) is adapted to essentially flow through the lower chamber 122L of the process vessel 122 without removing any of the solids entrained in the process fluid 115. As noted above, solids material will be stripped from the portion of the production fluid 115 that flows through the openings 124A in the baffle plate 124 so as to produce the relatively clean production fluid 150 that is supplied to the pumps 126, 128. In fact, in the systems disclosed herein, the additional solids materials that are stripped from the process fluid 115 by the baffle plate 124 are re-entrained in (or added to) the production fluid 115 as it flows through the lower chamber 122U of the vessel 122. The vessel lift-gas inlet 122D may be provided so that, if desired, any particulate material that is on the bottom of the lower chamber 122L may be occasionally or constantly "stirred" so that any such materials may be re-entrained into the production fluid 115 as it flows through the lower chamber 122L of the process vessel 122. The introduction of the pressurized lift-gas 108X into the lower chamber 122L may also assist in "pushing" the production fluid 115 out of the lower chamber 122L. Of course, the vessel lift-gas inlet 122D need not be provided in all applications. In cases where it is provided, it may be coupled to a distribution grid (not) positioned within the lower chamber 122L of the process vessel 122.

Figure 8:
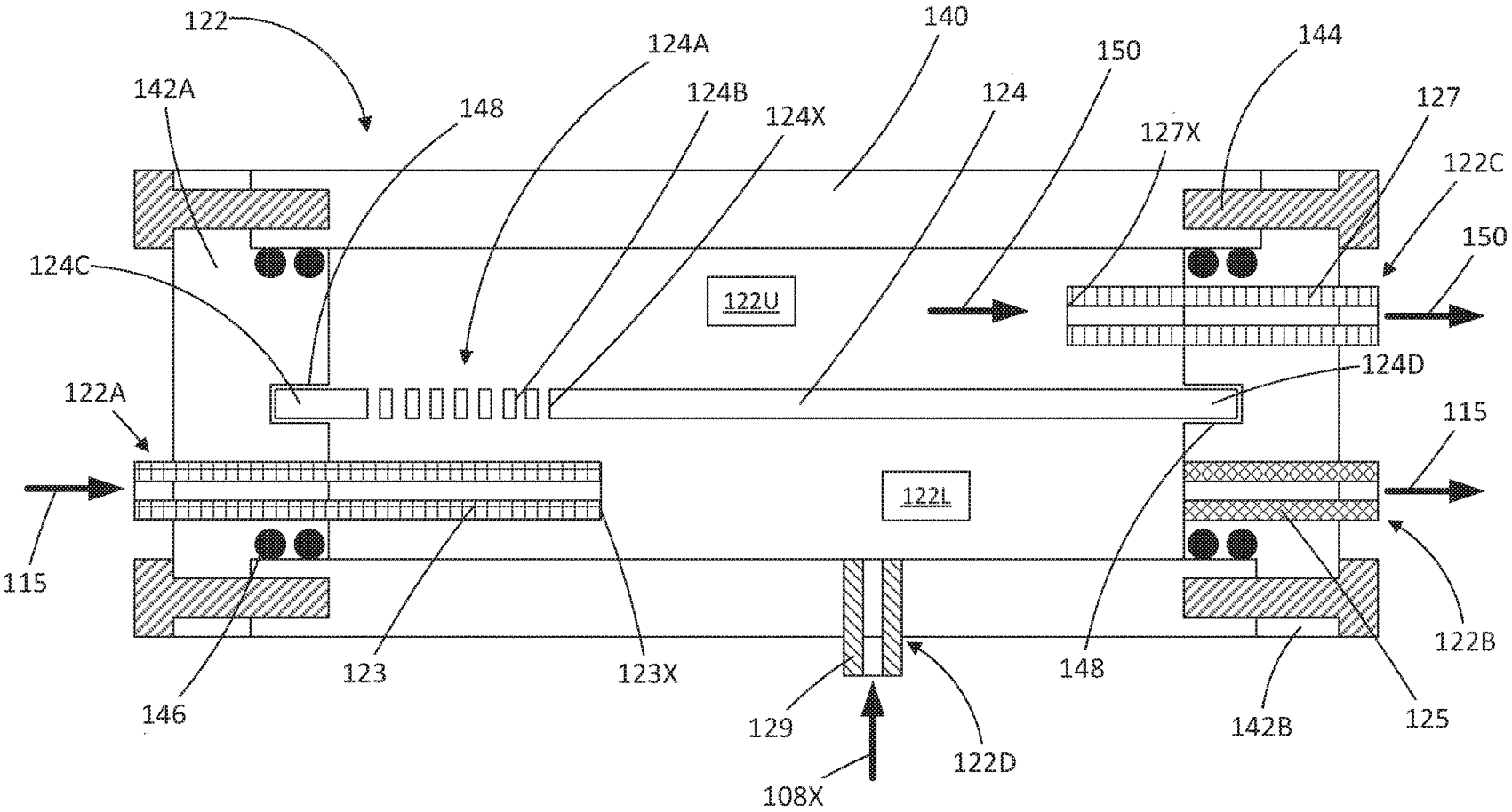
FIG. 8 is a simplistic cross-sectional view of one illustrative embodiment of a process vessel that may be include as part of one illustrative embodiment of a blockage remediation skid disclosed herein.

FIG. 8 is a cross-sectional side view of one illustrative embodiment of the process vessel 122. As depicted, the process vessel 122 comprises a tubular body 140 (a pipe or a forging), opposing end caps 142A-142B that are coupled to the body 140 by a plurality of bolts 144, and simplistically depicted seal rings 146. The baffle plate 124 is positioned within slots 148 formed in each of the end caps 142 such that the baffle plate 124 essentially "floats" within the process vessel 122. A production fluid inlet pipe 123 is positioned (e.g., welded) in the end cap 142A such that production fluid 115 is introduced into the lower chamber 122L of the process vessel 122. The inlet pipe 123 has an outlet 123X that is located within the lower chamber 122L and below the baffle plate 124. The outlet 123X extends axially past the end 124X of the plurality of openings 124A in the baffle plate 124 by a distance of at least about 76-27 mm (about 3-5 inches). A production fluid outlet pipe 125 is positioned within the end cap 142B below the baffle plate 124. The outlet pipe 125 is adapted to receive production fluid 115 flowing from the lower chamber 122L. A clean production fluid outlet pipe 127 is positioned in the end cap 142B and above the baffle plate 124. The clean production fluid outlet pipe 127 is adapted to receive the relatively clean production fluid 150 that is to be supplied to the pumps 126, 128, and it has an entrance 127X that may be located a short distance from the back side of the end cap 142B. Also depicted is a pressurized lift-gas inlet pipe 129 that is positioned in the body 140, so as to, if desired or needed, introduce some quantity of pressurized lift-gas 108X into the lower chamber 122L. In one illustrative example, the process vessel 122 depicted in FIG. 8 may be physically very small relative to the physical size of the separator/sump vessel 23 described in the background section of this application. For example, the process vessel 122 may have an outer diameter on the order of about 152-203 mm (about 6-8 inches) and an overall length of about 1.8-2.4 meters (about 6-8 feet). Additionally, in one embodiment, the pipes 123, 125, 127 and 129 may have an inner diameter of about 25.4 mm (about 1 inch). Of course, these illustrative dimensions may vary depending upon the particular application.

Figure 9:
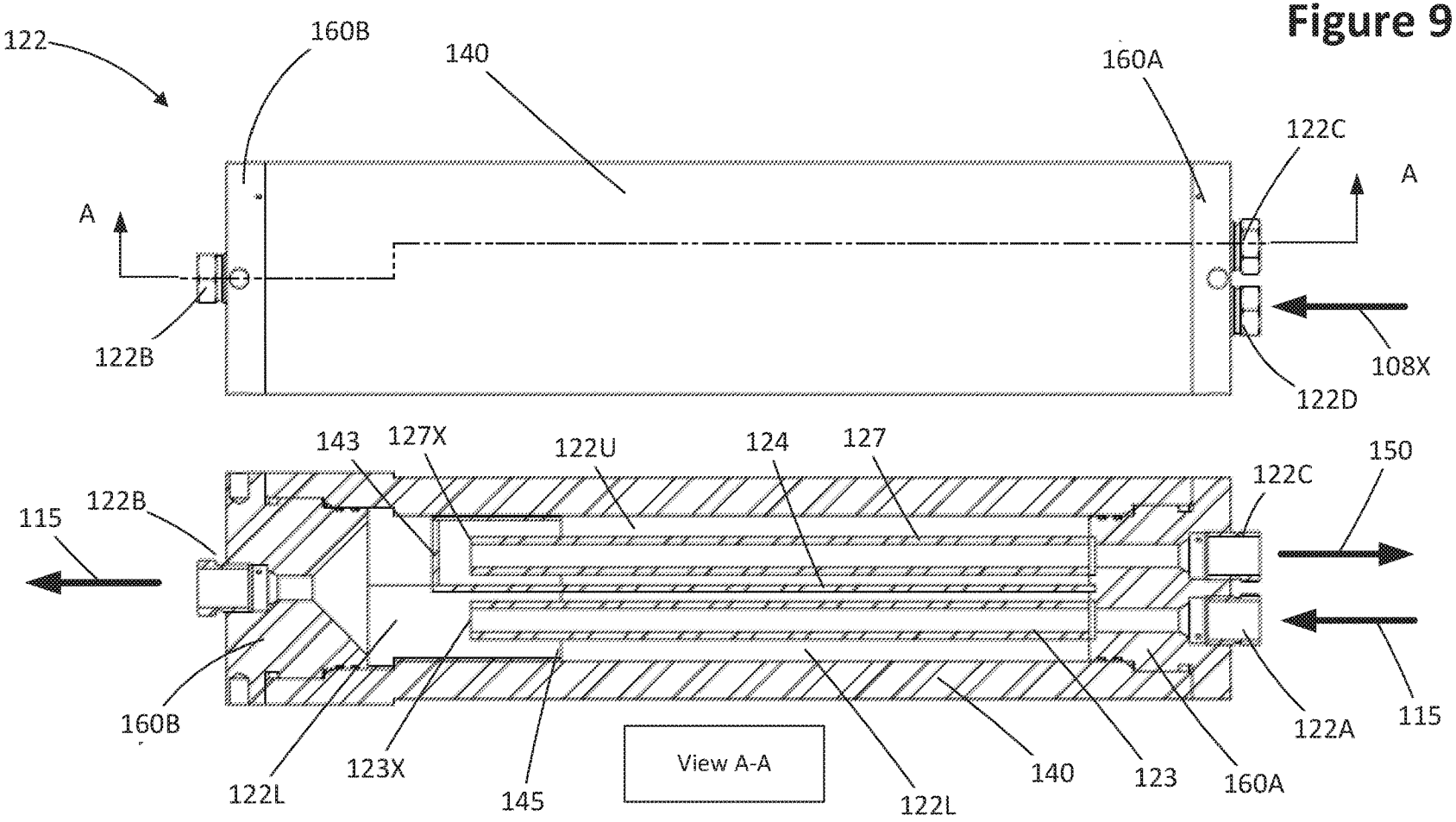
FIGS. 9 and 10 are various views of another illustrative embodiment of a process vessel that may be included as part of one illustrative embodiment of a blockage remediation skid disclosed herein.
Figure 10:
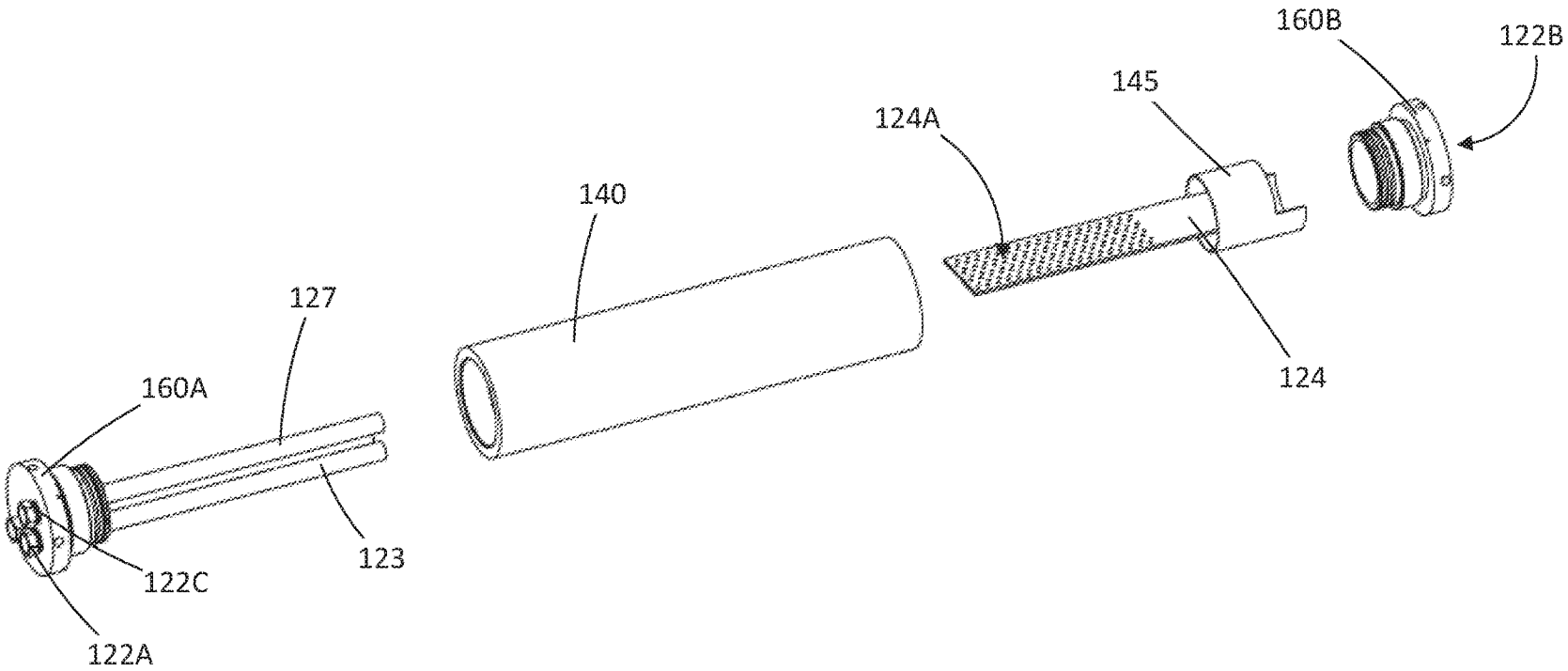

FIG. 9 and 10 are views of another illustrative embodiment of a process vessel 122 that may be included as part of one illustrative embodiment of a blockage remediation skid 104 disclosed herein. Relative to the embodiment shown in FIG. 8. In this embodiment, the process vessel 122 includes first and second end caps 160A and 160B that are threadingly coupled to the tubular body 140. In this embodiment, a semi-circular end plate 143 and a generally circular cover 145 is fixed (e.g., welded) to the baffle plate 124. The circular cover 145 essentially covers the inlet 127X of the clean production fluid outlet pipe 127. The dimensions of the process vessel 122 depicted in FIGS. 9 and 10 may be about the same as those indicated above for the process vessel 122 shown in FIG. 8.

Returning to FIG. 6, and as noted above, in one illustrative embodiment, the blockage remediation skid 104 may also comprise two illustrative pumps 126, 128. Of course, in some applications only a single pump may be included as part of the blockage remediation skid 104. As depicted, the pumps 126, 128 are adapted to receive the relatively clean production fluid 150 and increase the pressure of the entering production fluid 150 such that a higher-pressure clean production fluid 150X is introduced to the line 152. In one illustrative embodiment, the pressure of the higher-pressure clean production fluid 150X may be about 3.5-4.1 MPA (about 500-600 psi) above the pressure of the incoming clean production fluid 150 that enters the pumps 126, 128. The higher-pressure clean production fluid 150X is introduced into the line 154 which receives production fluid 115 from the outlet 122B of the process vessel 122. One or both of the pumps 126, 128 may be placed into operation at any given time during remediation operations depending upon the changing conditions that may be encountered in operation. One purpose of the pumps 126, 128 is to effectively reduce or drawn-down the pressure of the production fluid 115 in the flowline 16 so as to promote hydrate sublimation of the blockage 20 (in the case of a hydrate plug) or increase the differential pressure across the blockage 20. The magnitude of this reduction in pressure may vary depending upon the particular application and process conditions. As depicted in FIG. 6, if desired, a line may be included within the blockage remediation skid 104 such that chemicals 116X (if available) may be supplied to the lines containing the fluid 150 entering the pumps 126, 128 so as to lessen the likelihood of hydrate formation in those lines when the pumps 126, 128 are operational.

In general, the pumps 126, 128 may be of any desired structure and they may have any desired pumping capacity. In one example, the pumps 126, 128 may be duplex pumps. The pumps 126, 128 need not have the same pumping capabilities. For example, in one illustrative embodiment, the pump 126 may be multi-stage, small stroke, duplex pump capable of pumping fluids at relatively large flow rates (e.g., on the order of about 11 $m^3$/hour (about 50 gal/min)). On the other hand, the pump 128 may be a single-stage, large stroke, low flow duplex pump capable of pumping fluids at relatively low flow rates (about 0.9-1.1 $m^3$/hour (about 4-5 gallons/minute). It should be noted that, even when one or more of the pumps 126, 128 are included as part of the blockage remediation skid 104, the pumps may not need to be used in all applications. That is, is some applications, the introduction of the pressurized lift-gas 108X alone into the production fluid 115 may be sufficient to reduce the pressure on, for example, the upstream side 20A of the blockage 20 to a sufficiently low level such that the blockage 20 sublimates (in the case of a hydrate blockage) or such that there is sufficient differential pressure across the blockage 20 so that the blockage it may be dislodged from the line 16. In view of the foregoing, it will be appreciated by those skilled in that art after a complete reading of the present application, that on-board pumps may not be need to be included on the blockage remediation skid 104 in all applications. In this later situation, if the pumps 126, 128 are not included as part of the blockage remediation skid 104, then at least the baffle plate 124 may be omitted as well.

The systems and methods disclosed herein generally involve the use of the use of gas-lift and/or suction principles to remove the blockage 20. More specifically, in one embodiment, the density of the fluid 115X in the returns downline 106 is reduced by injecting the non-volatile pressurized lift-gas 108X into the return line 106 that is coupled to the ROV 102, using either of the system configurations depicted in FIG. 3 or 4. This effectively reduces the hydrostatic head acting on one side of the blockage 20 (e.g., on the upstream side 20A of the blockage 120 when the blockage remediation skid 104 is operatively coupled so as to have access to the upstream side 20A of the blockage 20) which, as noted above, can lead to sublimation of a hydrate blockage and/or creating enough differential pressure across the blockage 20 such that it may be dislodged from the flowline 16. The instrumentation and flow control devices on the blockage remediation skid 104 permits the optimization of various flow rates of fluids and the pressure draw down at the blockage remediation skid 104 as conditions change as the blockage remediation process operation progresses. By monitoring the output of the instrumentation (e.g., the pressure gauge readings) on board the blockage remediation skid 104, the operator of the ROV 102 can remotely change the amount of pressurized lift-gas 108X injected and/or which of the pumps 126, 128 to employ during various stages of the operation. In one particular example, by injecting pressurized lift-gas 108X at a relatively high flow rate (e.g. about 56.7 $m^3$/min (about 2000 $ft^3$/min) or greater) into the returns downline 106, the returns downline 106 may be essentially emptied of the liquid process fluid in the line 106. As a result, only the pressure head due to the pressurized lift-gas 108X is present between the surface 11 and the blockage remediation skid 104. Depending upon the depth of the water and the pressure inside the flowline 16, the resulting pressure differential may be sufficient to initiate suction on one side of the blockage 20 such that the blockage 20 is sublimated (e.g., a hydrate blockage) and/or mechanically dislodged from the flowline 16 as production fluid 115 flows from the blocked flowline/equipment, into the blockage remediation skid 104 and into the returns line 106 to the vessel 10. That is, in this example, the pumps 126, 128 may not be needed to "melt" or dislodge the blockage 20.

As will be appreciated by those skilled in the art after a complete reading of the present application, the novel systems 100 and blockage remediation skid 104 disclosed herein provide the operator of the system with great flexibility and several options as to how to remove blockage 20 from subsea flowlines and equipment. That is, by adjusting the various valves and flow conditions on board or in proximity to the blockage remediation skid 104, the desired fluid and pressure conditions may be created either upstream or downstream of the blockage 20 by operatively coupling various process lines at various desired locations. As discussed above, the pressurized lift-gas 108X may be used to reduce the pressure on the upstream side 20A of the blockage 20. In another example, the line 110 could, in alternating fashion, be coupled to access points on the upstream side 20A and the downstream side 20B of the blockage 20 so as to effectively try to "push-pull" on the blockage 20 to dislodge the blockage 20, or to initiate a depressurization on both sides of the blockage 20, in order to accelerate its dissolution and therefore reduce the remediation time and corresponding cost. Similarly, by adjusting the appropriate valves within the blockage remediation skid 104, the higher pressure fluid 150X may be routed to the line 110 so as to inject relatively higher pressure fluid on the upstream side 20A and/or the downstream side 20B of the blockage 20 so as to try to dislodge the blockage 20. Additionally, blockage inhibitors (e.g. hydrates or other blockages inhibitors obtained from the belly skid 114 on the second ROV 112 or elsewhere) may be routed to the line 110, the production fluid 115 as it enters the skid 104 and/or to the fluid 150 supplied to the suction side of the pumps 126, 128 so as to prevent the formation of new blockages until normal production operations can be re-established.

After a complete reading of the present application, those skilled in the art will appreciate several unique and functional aspects (some of which are discussed below in no particular order of importance) of the various novel systems, methods and devices disclosed herein that are useful in removing blockages, e.g., hydrate plugs, debris plugs, etc., from subsea flowlines and subsea equipment.

Relative to the prior art technique discussed in the background section of this application, the systems 100 disclosed herein eliminate the need for positioning the flowline remediation skid 22 and the chemical storage tank 34 on the sea floor 13, thereby eliminating the problem of finding space on the sea floor 13 for such equipment. Moreover, in older fields, there may be pre-existing lines and/or equipment but the precise location of this infrastructure may be difficult to locate since the lines and/or equipment may have been effectively buried in the mud at the sea floor 13 over the years. If an extensive site survey of the sea floor is not performed, placement of the prior art remediation equipment on the sea floor 13 runs the risk of damaging the pre-existing lines and equipment. Additionally, by eliminating the need for positioning the prior art flowline remediation skid 22 on the sea floor 13, the issues associated with fabricating, delivery, installation and retrieval of such large and heavy equipment is eliminated. As noted above, should chemicals be needed during blockage remediation process operations performed using the systems described herein, such chemicals may be provided by the second ROV 112 with a belly skid 114 that contains the required chemicals. However, in other embodiments, chemicals need in the blockage remediation process may be available on other subsea equipment already positioned on the sea floor, e.g., the tree 12. Additionally, since the production fluid 115X is sent to the vessel 10 (via returns line 106) and not stored at the sea floor 13, the capacity to handle the production fluid 115X on board the vessel 10 should not be a major issue. If additional volume capacity is needed, additional supply vessels with transfer lines can be positioned alongside the vessel 10 to offload partially treated production fluid 115X, solids/debris from the blockage removal process and provide more lift-gas supplies to the vessel 10.

It should also be noted that, to the extent the vessel 10 is driven off location or out-of-position during operations, there is only one emergency disconnect and shut-off point 110X or 16X (see FIGS. 3 and 4) that needs to be addressed. All of the other equipment is suspended from the vessel 10 and will move or drift with the vessel 10 as the vessel 10 moves off location. In general, relative to the prior art technique disclosed in the background section of this application, the systems disclosed herein simplify equipment configurations at the sea floor 13, eliminates the sump/separator vessel 23 (see FIG. 2) positioned at the sea floor 13 (which greatly increases water depth capabilities and reduces lifting requirements for the vessel 10) and provides great flexibility in terms of volumes of gas or fluids that can be handled without any additional deployment or retrieval operation. Importantly, all of the equipment used in the systems disclosed herein is suspended in the water and moved via ROV propulsion, and the power and control requirement for the system utilize the power/control systems that are resident on the ROV platform, i.e., no additional or external power/control platform is needed. Additionally, the present systems 100 should involve much less capital investment and much less maintenance expenditures relative to the prior art systems shown in FIGS. 1 and 2, and would likely enable shorter operational times due to the minimal set of equipment to be deployed and retrieved. Other advantages and benefits of the systems disclosed herein will be appreciated by those skilled in the art after a complete reading of the present application.

The particular embodiments disclosed above are illustrative only, as the invention may be modified and practiced in different but equivalent manners apparent to those skilled in the art having the benefit of the teachings herein. For example, the process steps set forth above may be performed in a different order. Furthermore, no limitations are intended to the details of construction or design herein shown, other than as described in the claims below. It is therefore evident that the particular embodiments disclosed above may be altered or modified and all such variations are considered within the scope and spirit of the invention. Note that the use of terms, such as "first," "second," "third" or "fourth" to describe various processes or structures in this specification and in the attached claims is only used as a shorthand reference to such steps/structures and does not necessarily imply that such steps/structures are performed/formed in that ordered sequence. Of course, depending upon the exact claim language, an ordered sequence of such processes may or may not be required. Accordingly, the protection sought herein is as set forth in the claims below

The invention claimed is:

1. A system for removing a blockage from a subsea flowline or subsea equipment, the system comprising:

an ROV deployed into a body of water from a surface vessel, the ROV having a blockage remediation skid operatively coupled to the ROV, the blockage remediation skid comprising at least a skid fluid inlet and a skid fluid outlet;

a returns downline extending into the body of water from the surface vessel, the returns downline being operatively coupled to the skid fluid outlet;

a pressurized lift-gas supply downline extending into the body of water from the surface vessel, the pressurized lift-gas supply downline being:

operatively and directly coupled to the blockage remediation skid and adapted to supply pressurized lift-gas from the pressurized lift-gas supply downline directly to the blockage remediation skid; or operatively and directly coupled to the returns downline and adapted to supply pressurized lift-gas from the pressurized lift-gas supply downline directly to the returns downline; and a remediation flow line that is operatively coupled to the skid fluid inlet and to a subsea flowline or an item of subsea equipment.

2. The system of claim 1, wherein the blockage remediation skid further comprises a skid pressurized lift-gas inlet and wherein the pressurized lift-gas supply downline is operatively and directly coupled to the blockage remediation skid via the skid pressurized lift-gas inlet.

3. The system of claim 1, wherein the system further comprises an access point on the returns downline and wherein the pressurized lift-gas supply downline is operatively and directly coupled to the returns downline via the access point.

4. The system of claim 1, wherein the system further comprises a second ROV deployed into the body of water from the surface vessel wherein the second ROV is adapted to at least to operatively couple the returns downline to the skid fluid outlet and to operatively couple the skid fluid inlet to the flowline or to the item of subsea equipment.

5. The system of claim 1, wherein the system further comprises:

a second ROV deployed into the body of water from the surface vessel wherein the second ROV comprises a chemical supply skid that is operatively coupled to the second ROV; and a skid chemical fluid inlet on the blockage remediation skid whereby at least one chemical from the chemical supply skid on the second ROV is adapted to be introduced into the blockage remediation skid via the skid chemical fluid inlet.

6. The system of claim 5, wherein the second ROV is adapted to couple the pressurized lift-gas supply downline to one of the blockage remediation skid or to the returns downline.

7. The system of claim 1, wherein the system further comprises at least one pump that is positioned on the blockage remediation skid wherein the at least one pump is adapted to receive at least a portion of a production fluid supplied to the blockage remediation skid via the skid fluid inlet and increase the pressure thereof when the at least one pump is in operation.

8. The system of claim 1, wherein the system further comprises:

a process vessel positioned within the blockage remediation skid;

a baffle plate positioned within the vessel so as to define at least a lower chamber and an upper chamber within the vessel, the baffle plate comprising a plurality of openings; and at least one pump that is adapted to receive production fluid from the upper chamber that has passed through the openings in the baffle plate and increase the pressure of the production fluid when the at least one pump is operational.

9. The system of claim 1, wherein the system further comprises:

a process vessel positioned within the blockage remediation skid and wherein the system is adapted to:

receive a production fluid from the subsea flowline or subsea equipment into the vessel; and introduce the production fluid from the pressure vessel into the returns downline via the skid fluid outlet.

10. The system of claim 1, wherein the system further comprises:

a process vessel positioned within the blockage remediation skid, the vessel comprising a vessel production fluid inlet that is in fluid communication with the skid fluid inlet and a vessel production fluid outlet that is in fluid communication with the skid process fluid outlet, wherein the system is adapted to:

allow introduction of the production fluid into the process vessel via a flow path that includes the skid fluid inlet and the vessel production fluid inlet; and allow introduction of the production fluid from the process vessel into the returns downline via a flow path that includes the vessel production fluid outlet and the skid fluid outlet.

11. The system of claim 7, wherein the system further comprises:

a process vessel positioned within the blockage remediation skid, the vessel comprising a lift-gas inlet wherein the system is adapted to supply pressurized lift-gas from the pressurized lift-gas supply downline to the vessel via the lift-gas inlet.

12. The system of claim 7, wherein the at least one pump is a duplex pump.

13. The system of claim 1, further comprising:

a first valve;

a second valve; and a third valve, wherein the first, second and third valves are configurable so as to define at least the following fluid flow paths:

a first flow path established by opening the first and second valves and closing the third valve, whereby pressurized lift-gas may flow down the pressurized lift-gas supply downline and into the remediation flow line while the returns downline is closed;

a second flow path established by opening the first valve and the third valve, whereby a production fluid from the flowline or the item of subsea equipment is received into the remediation flow line and may flow into the returns downline while the pressurized lift-gas supply downline is closed; and a third flow path that is established by opening the second and the third valves and closing the first valve, whereby pressurized lift-gas may flow down the pressurized lift-gas supply downline and into the returns downline while the remediation flow line is closed.

14. The system of claim 13, wherein the first, second and third valves are each individual valves.

15. The system of claim 13, wherein the first, second and third valves are part of a multiple-way valve.

16. The system of claim 13, wherein each of the first, second and third valves are positioned within the blockage remediation skid.

17. A blockage remediation skid that is adapted to be operatively coupled to an ROV, the skid comprising:

a skid fluid inlet;

a remediation flow line that is adapted to be placed in fluid communication with the skid fluid inlet;

a skid fluid outlet that is adapted to be placed in fluid communication with a returns downline from a surface vessel;

a skid pressurized lift-gas inlet that is adapted to be placed in fluid communication with a pressurized lift-gas supply downline from the surface vessel and to receive pressurized lift-gas from the surface vessel via the pressurized lift-gas supply line, wherein the skid fluid outlet is adapted to return the pressurized lift-gas to the surface vessel via the returns downline; and a process vessel that is adapted to receive a production fluid from a subsea flowline or an item of subsea equipment via the remediation flow line, wherein the skid fluid outlet is further adapted to return the production fluid received by the process vessel to the surface vessel via the returns downline.

18. The blockage remediation skid of claim 17, wherein the process vessel further comprises:

a vessel production fluid inlet that is in fluid communication with the skid fluid inlet wherein the production fluid is adapted to be introduced into the process vessel via a flow path that includes the skid fluid inlet and the vessel production fluid inlet; and a vessel production fluid outlet that is in fluid communication with the skid process fluid outlet, wherein the production fluid from the process vessel is adapted to be introduced into the returns downline via a flow path that includes the vessel production fluid outlet and the skid fluid outlet.

19. The blockage remediation skid of claim 17, further comprising a skid chemical fluid inlet that is adapted to receive at least one chemical from a chemical supply source and introduce the at least one chemical to at least one process line positioned within the blockage remediation skid.

20. The blockage remediation skid of claim 17, further comprising a baffle plate positioned within the vessel so as to define at least a lower chamber and an upper chamber within the vessel, the baffle plate comprising a plurality of openings.

21. The blockage remediation skid of claim 20, wherein the vessel further comprises a vessel production fluid outlet that is adapted to receive production fluid that has passed through the openings in the baffle plate.

22. The blockage remediation skid of claim 20 wherein the process vessel further comprises:

a vessel production fluid inlet that is adapted to allow the production fluid to only be introduced into the lower chamber of the process vessel below the baffle plate;

a vessel production fluid outlet that is adapted to remove the production fluid only from the lower chamber of the process vessel below the baffle plate; and a production fluid outlet that has an inlet that is positioned within the upper chamber and adapted to receive only production fluid that has passed through the openings in the baffle plate.

23. The blockage remediation skid of claim 21, wherein the blockage remediation skid further comprises at least one pump that is adapted to receive the production fluid and increase the pressure thereof when the at least one pump is in operation.

24. The blockage remediation skid of claim 17, wherein the blockage remediation skid further comprises at least one pump that is adapted to increase a pressure of a production fluid received from the vessel so as to produce a production fluid having an increased pressure, wherein the production fluid is introduced into the returns downline via the skid fluid outlet.

25. The blockage remediation skid of claim 17, wherein the blockage remediation skid further comprises first and second pumps each of which are adapted to increase a pressure of a production fluid received from the vessel so as to produce a production fluid having an increased pressure, wherein the production fluid is introduced into the returns downline via the skid fluid outlet.

26. The blockage remediation skid of claim 25, wherein each of the first and second pumps is a duplex pump.

27. The blockage remediation skid of claim 17, wherein the vessel further comprises a lift-gas inlet that is adapted to receive pressurized lift-gas from the pressurized lift-gas supply downline.

28. The blockage remediation skid of claim 17, further comprising:

a first valve;

a second valve; and a third valve, wherein the first, second and third valves are configurable so as to define at least the following fluid flow paths:

a first flow path established by opening the first and second valves and closing the third valve, whereby pressurized lift-gas may flow down the pressurized lift-gas supply downline and into the remediation flow line while the returns downline is closed;

a second flow path established by opening the first valve and the third valve, whereby the production fluid may flow into the returns downline while the pressurized lift-gas supply downline is closed; and a third flow path that is established by opening the second and the third valves and closing the first valve, whereby pressurized lift-gas may flow down the pressurized lift-gas supply downline and into the returns downline while the remediation flow line is closed.

29. The blockage remediation skid of claim 28, wherein the first, second and third valves are each individual valves.

30. The blockage remediation skid of claim 28, wherein the first, second and third valves are part of a multiple-way valve.

31. The blockage remediation skid of claim 28, wherein each of the first, second and third valves are positioned within the blockage.

* * * * *